US007486058B2

(12) United States Patent
Szepesi

(10) Patent No.: US 7,486,058 B2
(45) Date of Patent: Feb. 3, 2009

(54) CIRCUIT AND METHOD COMBINING A SWITCHING REGULATOR WITH ONE OR MORE LOW-DROP-OUT LINEAR VOLTAGE REGULATORS FOR IMPROVED EFFICIENCY

(76) Inventor: Thomas Szepesi, 12846 Arroyo de Arguello, Saratoga, CA (US) 95070

( * ) Notice: Subject to any disclaimer, the term of this patent is extended or adjusted under 35 U.S.C. 154(b) by 266 days.

(21) Appl. No.: 11/420,457

(22) Filed: May 25, 2006

(65) Prior Publication Data

US 2006/0267562 A1 Nov. 30, 2006

Related U.S. Application Data

(60) Provisional application No. 60/684,702, filed on May 25, 2005, provisional application No. 60/685,436, filed on May 28, 2005.

(51) Int. Cl.
*G05F 1/56* (2006.01)

(52) U.S. Cl. ..... 323/272; 323/282

(58) Field of Classification Search ..... 323/282–288, 323/224; 341/156–158
See application file for complete search history.

(56) References Cited

U.S. PATENT DOCUMENTS

| | | | | |
|---|---|---|---|---|
| 4,675,594 | A * | 6/1987 | Reinke | 323/317 |
| 4,928,056 | A * | 5/1990 | Pease | 323/314 |
| 6,208,644 | B1 * | 3/2001 | Pannell et al. | 370/389 |
| 6,850,046 | B2 * | 2/2005 | Chapuis | 323/282 |

* cited by examiner

*Primary Examiner*—Rajnikant B Patel

(57) ABSTRACT

Various embodiments provide a system comprising a regulator and one or more low-drop-out linear regulators for improved efficiency. In one embodiment, a system comprises a regulator and one low-drop-out linear regulator comprising a pass transistor, and furthermore, another transistor matched to the pass transistor except for size. The matching transistor provides information regarding the source-drain voltage drop of the pass transistor. A controller circuit makes use of this information to set the regulator's output voltage to improve the efficiency of the system. Other embodiments are described and claimed.

54 Claims, 18 Drawing Sheets

CIRCUIT AND METHOD COMBINING A SWITCHING REGULATOR WITH ONE OR MORE LOW-DROP-OUT LINEAR VOLTAGE REGULATORS FOR IMPROVED EFFICIENCY

CLAIM OF BENEFIT OF PROVISIONAL APPLICATIONS

This application claims the benefit of provisional application "Drop out linear regulators for improved efficiency", filed 25 May 2005, U.S. Ser. No. 60/684,702; and the provisional application "Circuit and method to combine a switching regulator and multiple low drop out linear regulators for improved efficiency", filed 28 May 2005, U.S. Ser. No. 60/685,436.

FIELD

Embodiments of the present invention relate to circuits, and more particularly, to voltage regulators.

BACKGROUND

In battery operated equipment, long battery life is very important. One factor influencing battery life is the efficiency of the voltage regulators used to power the different subsystems in the equipment. Switching regulators (SWR) provide among the highest efficiency, and they are widely used. However, switching regulators are relatively expensive and take-up a relatively large amount of printed circuit board area. As a result, linear low drop out regulators (LDOs) are widely used where lower efficiency can be tolerated. This results in systems that typically have a few SWRs and a large number of LDOs.

The LDOs operate with reasonably high efficiency if the difference between their input voltage, Vin, and output voltage, Vout, is small relative to Vout. This voltage difference is referred to as an overhead voltage Vovh, where Vovh=Vin−Vout. Neglecting ground current, the efficiency, Eff, may be expressed as follows $$Eff=(Pout/Pin)\sim(Vout/Vin)=Vout/(Vout+Vovh)=1/(1+Vovh/Vout).$$

If LDOs are used between the battery and the subsystems, the efficiency changes as the battery voltage decreases through the discharge cycle. The efficiency starts out low for a fully charged battery, and increases as the battery voltage, Vbat, decreases toward its minimum voltage.

Combining an SWR and LDO in a cascade fashion, where the SWR's input is the battery voltage and the SWR's output voltage provides the LDO's input voltage, is often used to improve the overall efficiency. An advantage of such a combination is that, as the LDO operates from the regulated output voltage of the SWR, the LDO's overhead is relatively constant and may be chosen low enough so as to provide a reasonably high overall efficiency for the combination. There also are advantages inherent to linear regulators, such as, for example, low noise, low ripple, and fast transient response. The output voltage of the SWR, Voswr, is typically set to Vout+Vovh, where Vovh is a fixed voltage. The SWR's control loop may either control the Voswr to equal Vout+Vovh, or regulate the Voswr so as to provide the required constant Vovh by forcing the difference of Voswr and Vout to be Vovh.

FIG. 1 shows one prior art solution, where the Voswr is controlled to be equal to Vref2=Voutmax+Vovh. This solution is sensitive to the Vout tolerances, and should be designed for Voutmax. The switching regulator is typically a buck regulator, but it may other types of regulators, such as a boost regulator or a buck-boost regulator, for example.

FIG. 2 shows the different voltages in a SWR-LDO regulator combination. It shows the different components of Vovh. The largest component is denoted as Vdsmin. This is the minimal drain-source voltage of PFET pass device 106 that ensures that device 106 operates in its saturated (pentode) region. (PFET stands for p-channel field-effect transistor.) This is important because operating the pass device in this region provides the LDO with high ripple rejection and good load transient response. Using a drain-source voltage larger than Vdsmin may be good for ripple rejection, but will result in a decrease in efficiency. If the drain-source voltage of the pass device 106 is lower than Vdsmin, the pass device operates in its triode mode with greatly reduced ripple rejection and degraded load transient response.

The value of Vdsmin depends on process parameters, temperature, output current and pass device size. In many prior art solutions Vovh, is chosen to be large enough to cover Vdsmin under worst case process parameters, junction temperature, highest output current, and smallest pass device size. Typically, Vdsmin may vary two to three times over the full parameter space. Designing Vdsmin for the worst case may result in a system that has lower than optimal efficiency for most cases and under most operating conditions.

The next, typically much smaller component of Vovh is the SWR's ripple voltage, denoted as Vswrripple/2 in FIG. 2. Switching regulators generate a ripple voltage at their output due to their switching nature. This is typically expressed as a peak-to-peak (pp) ripple voltage around their DC output voltage. Half of this pp ripple voltage, Vswrripple/2, is part of Vovh. Vswrripple depends on the SWR's external storage components, such as capacitor C 108 and an inductor (not shown), and also depends upon the switching frequency. The next component of Vovh is the maximum load transient excursion of Voswr during the maximum specified positive load transient, Voswtrmax. Voswtrmax depends on the inductor (not shown) of the SWR, the value and ESR (equivalent series resistance) of the capacitor C 108, and the speed of its control loop. The final component, dVoswr, is the maximum deviation of Voswr from its nominal value due to component tolerances, temperature variation, and static line and load regulation. If the Voswr is set by this Vovh above the Voutmax, the LDO's pass device should operate in its saturated (pentode) region under all operating and ambient conditions with high efficiency, high ripple rejection and good load transient response.

FIG. 3 shows an alternative prior art implementation. In this implementation, the control loop of the SWR regulates the Voswr to be Vovh above the actual Vout of the LDO. This is accomplished by Error amplifier 102 forcing Voswr=Vout+Vovh. An advantage of this solution, compared to the one shown in FIG. 1., is that Voswr tacks the actual Vout with the constant Vovh overhead. As the tolerance of Vout is not part of the Voswr control loop, Voswr and Vout are closer to each other, resulting in higher efficiency. However, a disadvantage of this solution is that the overhead, Vovh, is constant and should be designed to meet worst case conditions over process, temperature, tolerances, and LDO operating conditions. This often results in over-design and lower efficiency for most operating conditions.

DESCRIPTION OF EMBODIMENTS

It is expected that the described embodiments provide an SWR-LDO regulator combination that has improved overhead, resulting in improved efficiency of the combined SWR-LDO regulator system. For some embodiments, it is also expected that there may be one or more of the following features: improved efficiency over process variation, junction temperature variation, output current variation, external component value ranges, and pass device sizes. It is also expected that the described embodiments has some of the advantages of the prior art LDO regulators, such as low output ripple voltage and fast load transient response.

Embodiments generate the overhead voltage Vovh in an adaptive way so as to track process parameter variations, temperature variations, and output current (e.g., load current) variations. Embodiments with both analog and digital control are described. An advantage of the digitally controlled embodiments is that they provide programmability and flexibility. They also enable the adjustment and optimization of the overhead in individual integrated circuit by measuring parameters on each individual unit during test, and enable the adjustment of the digitally stored parameters in the digital controller's non-volatile memory for minimal optimal overhead.

Throughout the description of the different embodiments of the invention, the SWR power stage 101 or 601 may be a buck, a boost, or a buck-boost topology, depending on the required value of Voswr relative to the Vin (e.g., the range of the battery voltage or other voltage source at the input of the SWR). The SWR power stage 101 or 601 may also represent a regulated high efficiency charge pump, in standard or fractional implementation. The power stages are not necessarily limited to these examples, so that other types of power stages may be used.

Figure 4A:
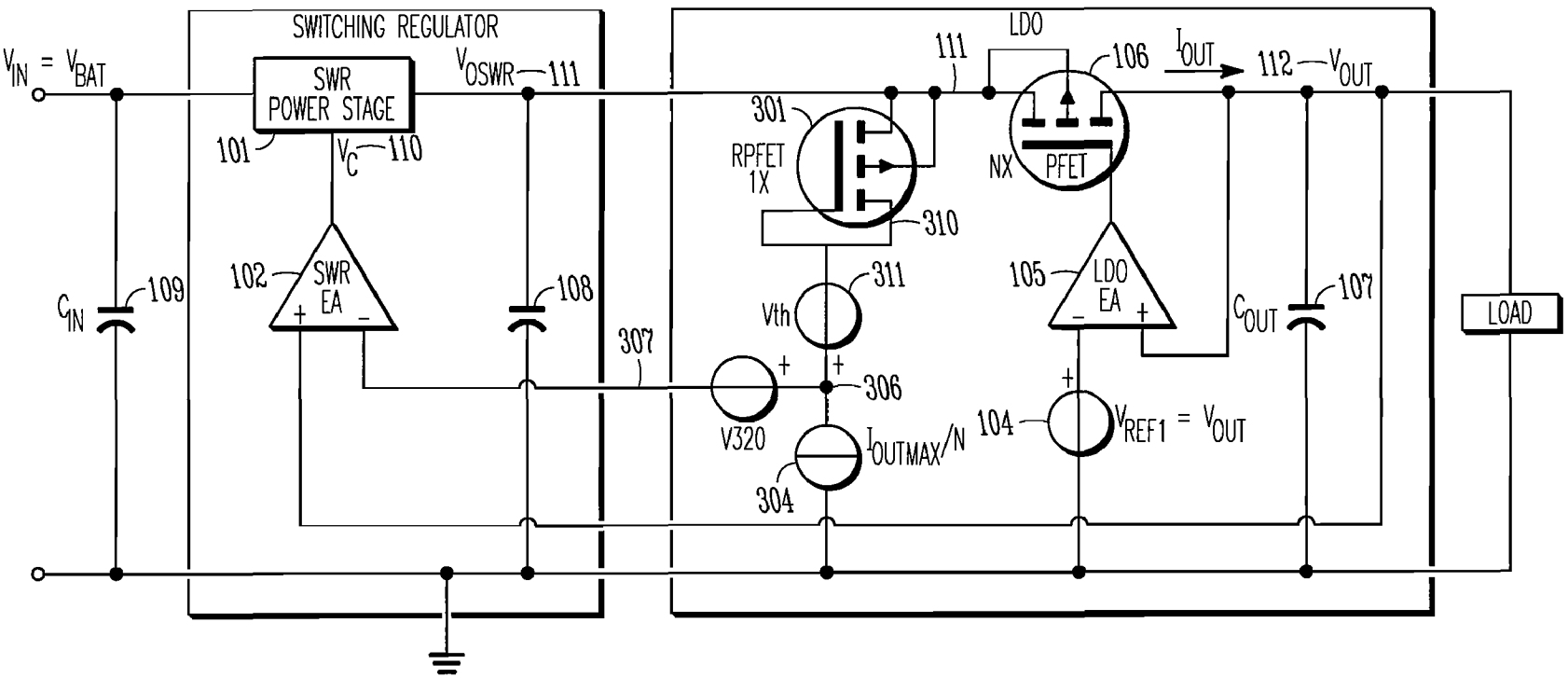
FIG. 4*a* shows the block diagram of one embodiment of the SWR-LDO combination in accordance with the invention.

FIG. 4*a* shows an embodiment of the invention. The output of the SWR, Voswr, is regulated by Error amplifier 102 via the Vc control voltage on line 110. Error amplifier 102 increases Voswr until the voltage on node 307 is equal to or close to Vout 112, resulting in V(307)=Vout. A FET (Field Effect Transistor), denoted as RPFET 301 in FIG. 4*a*, is used to generate the Vdsmin part of Vovh. RPFET 301 is matched to, but a much smaller version of, pass PFET 106. (RPFET serves as a mnemonic for Replica PFET). In this context, then, to state that transistors are matched does not imply that the sizes of the transistors are matched. For example, the ratio of sizes (where the size of a transistor is the ratio of channel width to channel length, W/L) for these two FETs may be set to some number N. The number N typically may be a number between 100 and 1000, depending on the maximum output current and other specifications, such as maximum ground current. In typical integrated circuit implementations, N is fixed by layout design.

Figure 1:
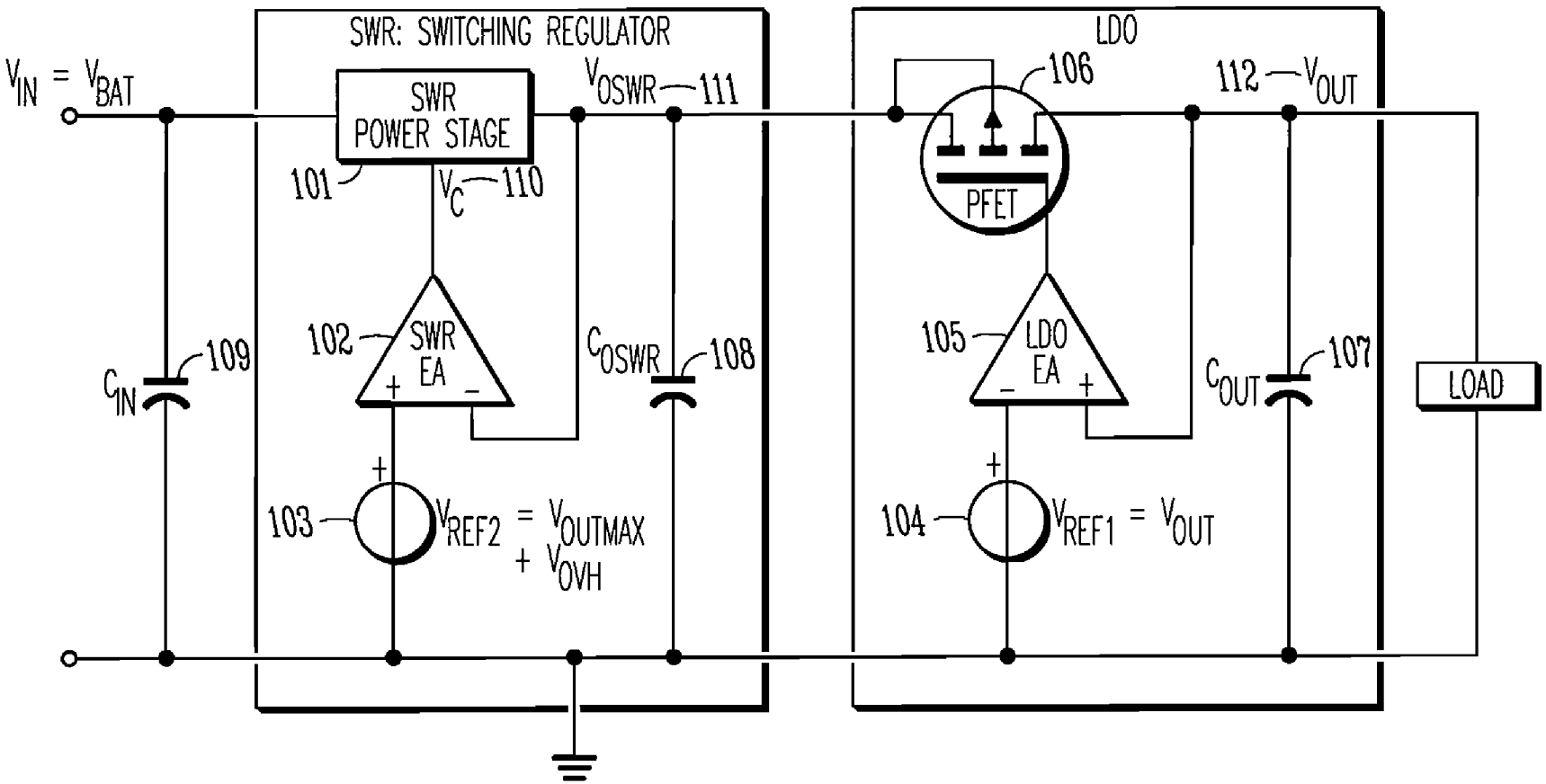
FIG. 1 shows the block diagram of a prior art SWR-LDO combination solution.
Figure 2:
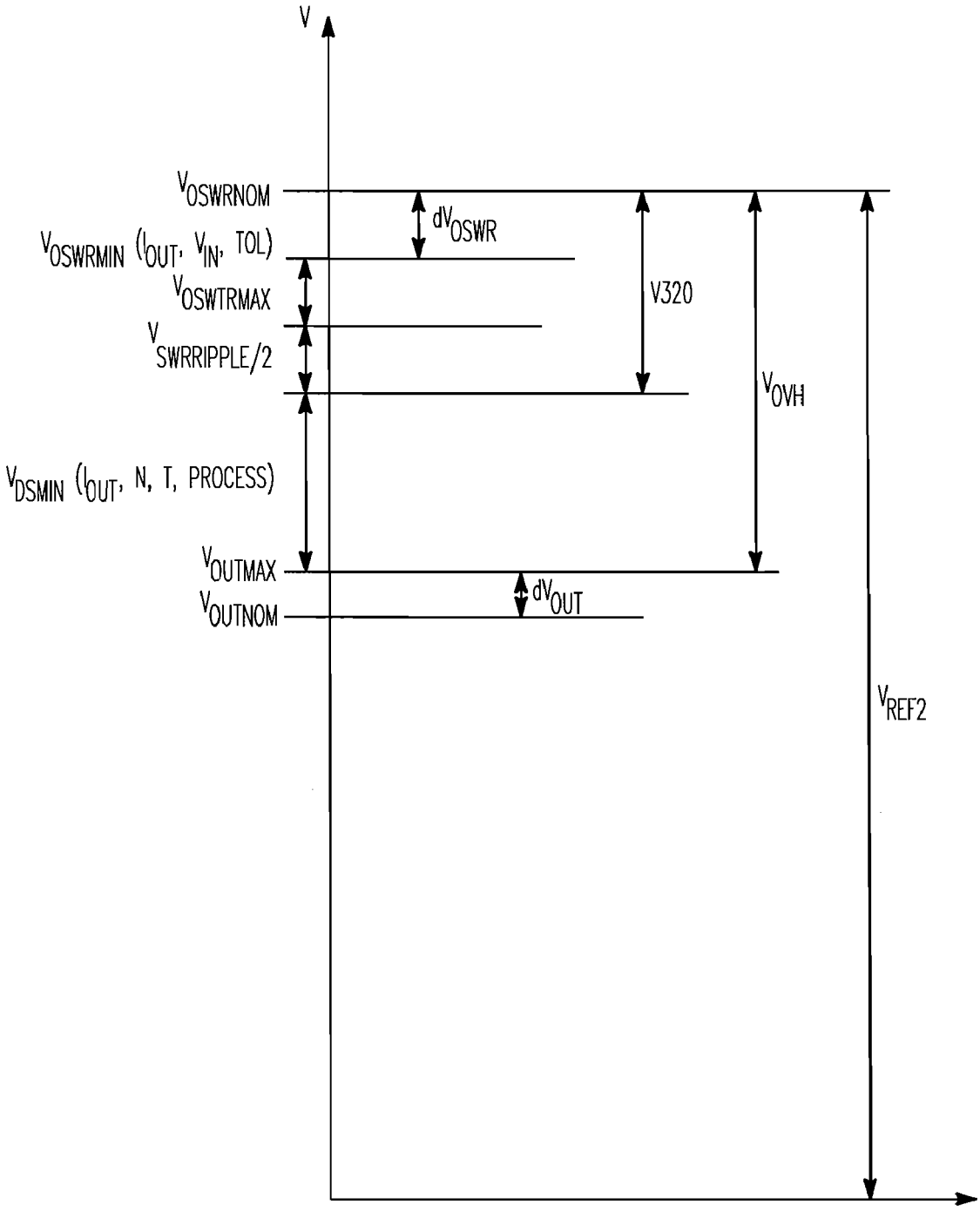
FIG. 2 shows the voltage map of the prior art SWR-LDO combination shown in FIG. 1.
Figure 3:
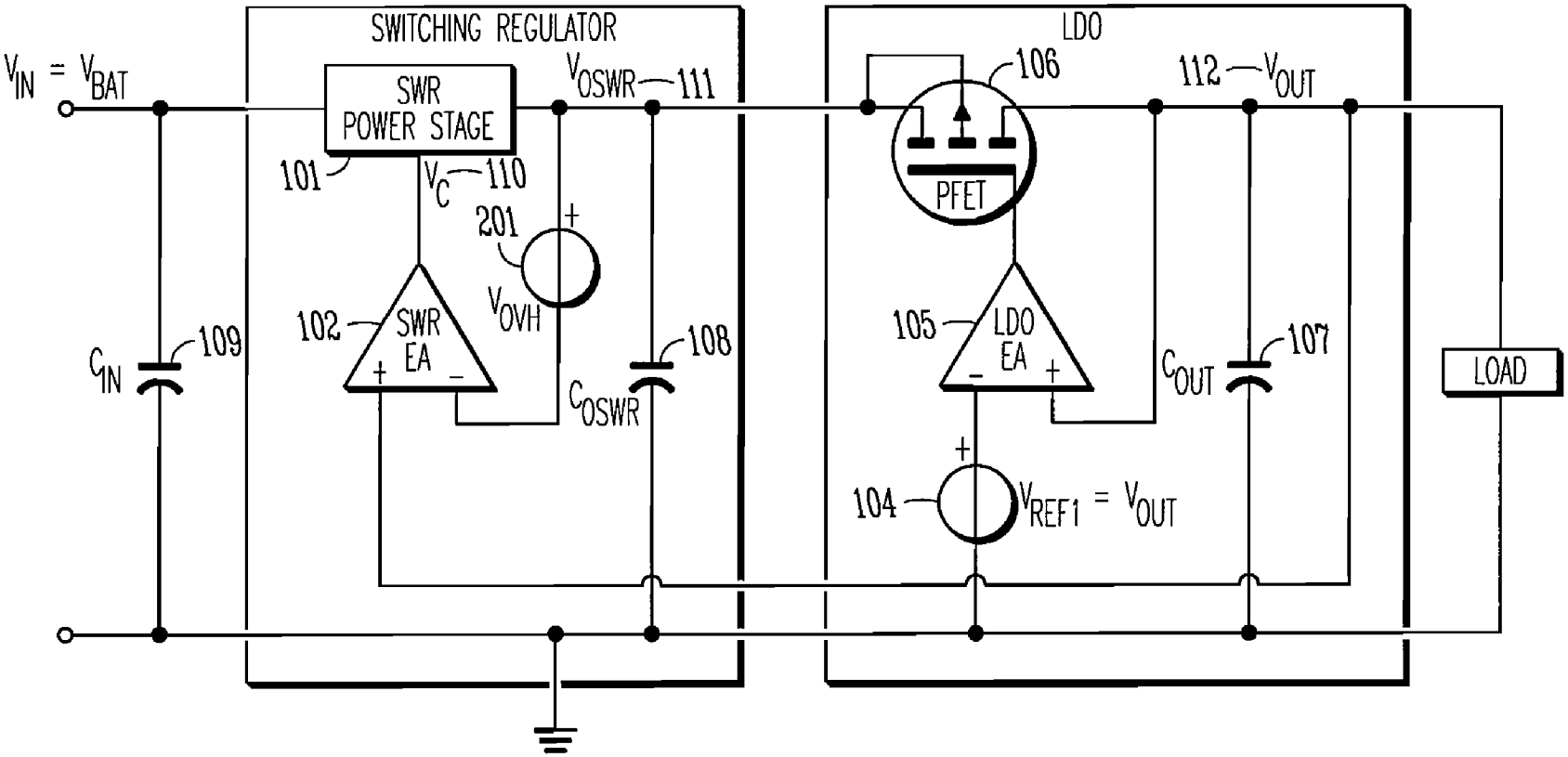
FIG. 3 shows an alternative block diagram of a prior art circuit.

The voltage difference between nodes 111 and 310 is approximately Vth+Vdsmin. Vth is the threshold voltage of RPFET 301, and the matching PFET 106. Voltage source 311 deducts the Vth from the voltage on node 310. This generates approximately Vdsmin between nodes 111 and 306. Vdsmin for RPFET 301 tracks the Vdsmin of pass PFET 106 at the maximum load current due to the scaled current source 304 that biases RPFET 301. Current source 304 biases RPFET 301 with 1/N of the maximum load current, the current scale factor being the inverse of the size scale factor between the two transistors 301 and 106. That is, for RPFET 301 to provide the same Vdsmin as PFET 106, the scaling should keep the ratio (Idsmax)/(device size) constant, e.g., (Ioutmax/N)=(Ioutmax/N)/1. Hence, the voltage between nodes 111 and 306 is approximately the Vdsmin of the pass PFET 106 at the maximum load current. As matching between devices is never perfect, in practice the current source 304 may be chosen such that it sources a current slightly higher than Ioutmax/N in order to cover the tolerance. V320 represents to sum of the other parts of Vovh: V320=dVoswr+Voswtrmax+Vswrripple/2 as indicated in FIG. 2. This results in a voltage difference of Vovh between nodes 111 and 307. Error amplifier 102 forces the Voswr to be Vovh higher than Vout, (Voswr−Vovh)=Vout, so that Voswr=(Vout+Vovh), as targeted for optimal operation. As RPFET 301 tracks pass PFET 106 over process variations and temperature variations, the overhead Vovh is expected to be the minimal value under all conditions. In practice, all circuit element values have tolerances, which may be covered by setting V320 slightly higher than required by the above described ideal calculation.

There are many ways known in the art to implement the V311 voltage source with a source voltage of Vth, and need not be detailed here. Also, there are different known circuits to generate the Vdsmin voltage between nodes 111 and 306. The circuit shown in the implementation of FIG. 4, and in other embodiments, is just one example for implementation.

Figure 4B:
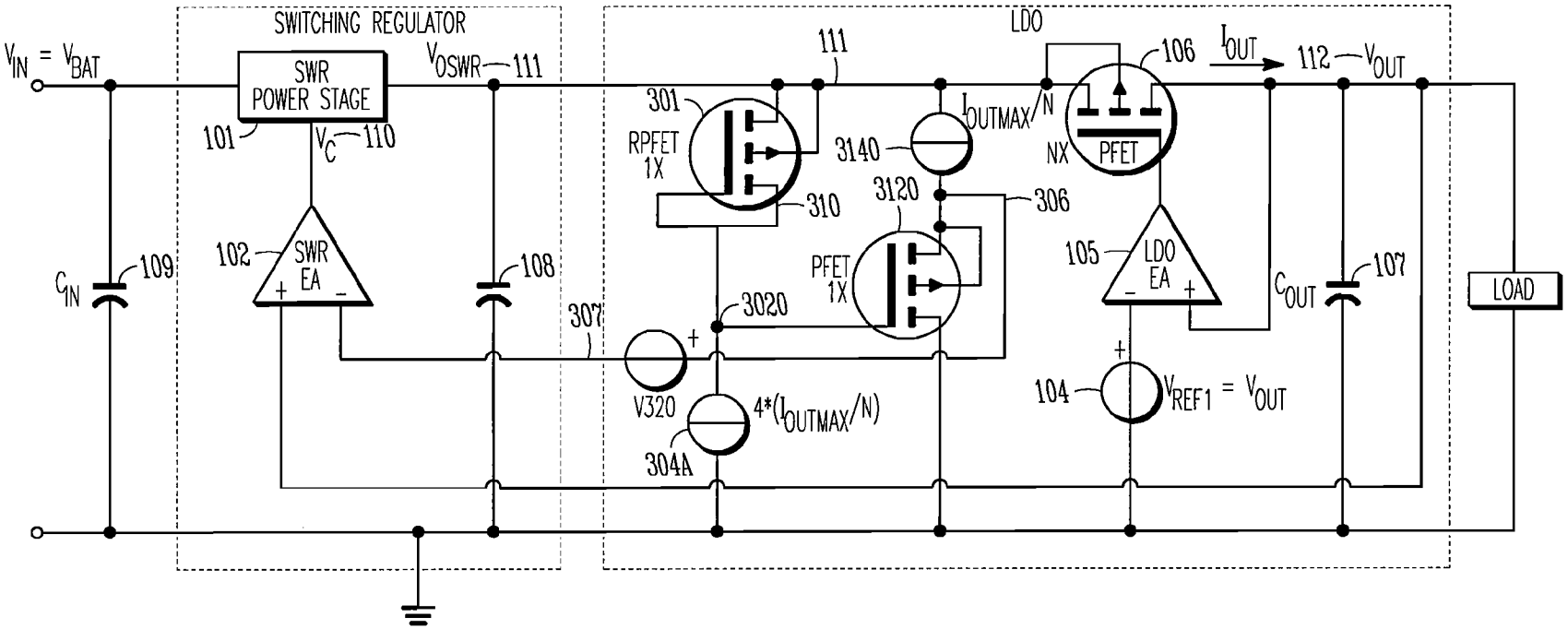
FIG. 4*b* shows the block diagram of another embodiment of the SWR-LDO combination in accordance with the invention.

FIG. 4*b* shows another known circuit to generate Vdsmin. It is well known that the drain current, Ids, for a MOSFET in the saturation region may be written as $$Ids=k(W/L)(Vgs-Vth)^2.$$

Rearranging the above expression gives $$(Vgs-Vth)=sqrt\{Ids/(k(W/L))\}=dV=Vdsmin,$$

where dV is the gate overdrive needed to generate the Ids current, which is known to be substantially equal to Vdsmin. The voltages are all positive, as shown, for NFETs, and are negative for PFETs. Diode connected RPFET 301 is biased by a current source 304*a* sourcing a current of 4*(Ioutmax/N). This biasing generates a drain-source voltage of Vgs (301) relative to rail 111, where $$Vgs(301)=-Vth-sqrt(4Ioutmax/(Nk(W/L)))=-Vth-2*sqrt(Ioutmax/(Nk(W/L))).$$

The Vgs of PFET 3120 is given by $$Vgs(3120)=-Vth-sqrt(Ioutmax/(Nk(W/L))).$$

The voltage between node 111 and node 306 is the difference between the gate sources voltages of PFETs 301 and 3120:

$$Vgs(301)-Vgs(3120)=-sqrt(Ioutmax/(Nk(W/L)))=Vdsmin.$$

Hence, the circuit of FIG. 4*b* implements the voltage source 331 in FIG. 4 via the Vgs voltage of PFET 3120, biased by current source 3140. Both PFETs 301 and 3120 are matched with the pass FET 106.

There are many known ways to implement the V320 voltage source. As an example, the V320 voltage source may be replaced by a resistor and current source 304 moved to the left side of such a resistor in FIG. 4*a*. The resistor value should be chosen so that $$R*Ioutmax/N=V320.$$

Another way to implement the V320 voltage source is to design a controlled offset voltage, with the value of the V320 voltage built into the 102 SWR error amplifier.

Figure 5:
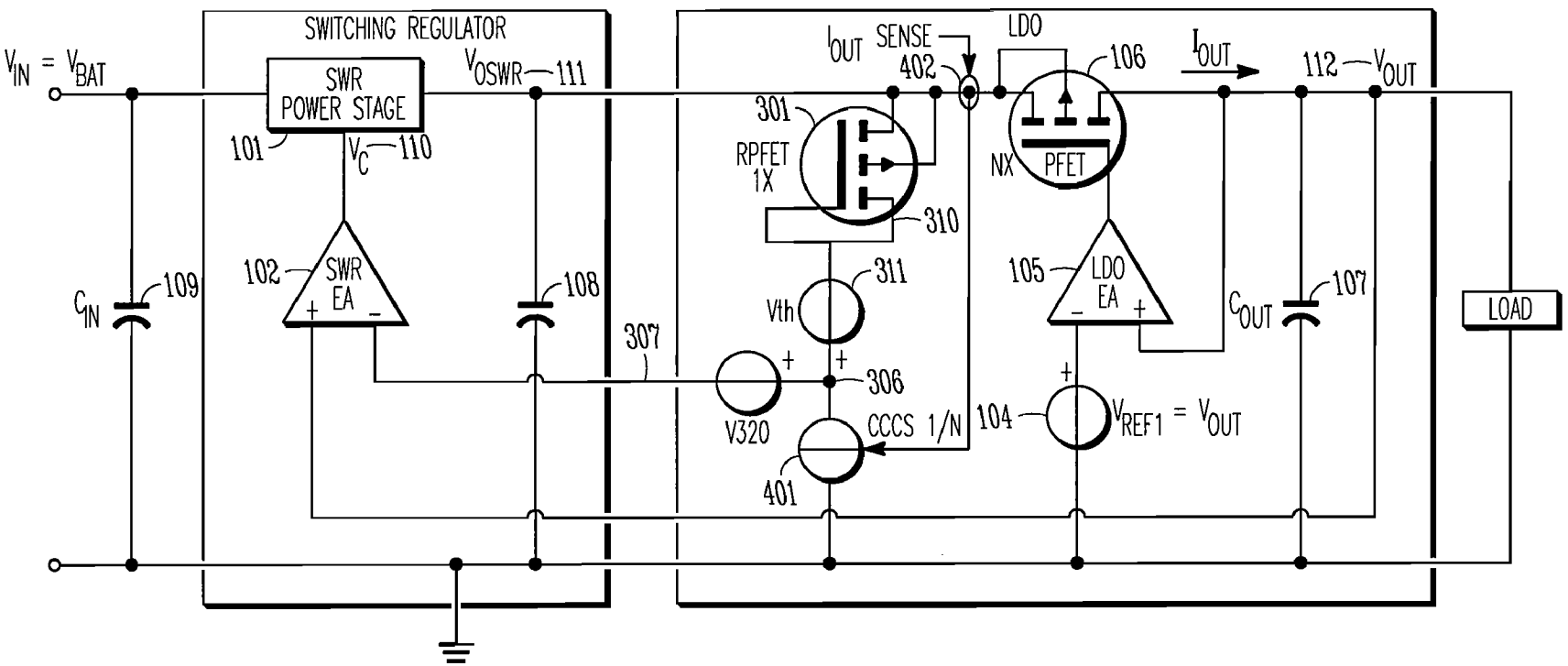
FIG. 5 shows an another embodiment of the invention

FIG. 5 shows another embodiment of the invention. The difference between this embodiment and the one shown in FIG. 4*a* is in the implementation of current source 304 biasing the RPFET 301. In FIG. 4*a*, there is a constant current source to provide a current of Ioutmax/N. The value of Ioutmax is a specification of the LDO, representing the maximum output current drawn from the LDO by the load. In the embodiment shown in FIG. 5, the current source is current controlled current source CCCS 401. This current controlled current source is controlled by the LDO's actual output current via current sense element 402. Current sense element 402 senses the source current of PFET 106, not the output current directly, but these two currents are the same because a field-effect transistor's source and drain currents are the same.

Current sense element 402 may be placed on the drain side of the PFET 106, without making a significant difference in the operation of the circuit. The value of the current generated by CCCS 401 tracks the LDO's actual output current Iout, where I(CCCS)=Iout/N. It is expected that this embodiment ensures efficient operation over the entire LDO output current range, rather than only at an output current of Ioutmax. There are many known ways in the art to implement current sense element 402 and CCCS 401. The implementation of CCCS 401 may include a low pass filter ensuring that the CCCS 401 does not react instantaneously to fast load current transients.

The circuit of FIG. 4*b* may be adapted to implement the output current tracking solution shown in FIG. 5 by replacing the 304*a* and 3140 constant current sources with current controlled current sources generating 4*Iout/N and Iout/N currents respectively.

Figure 6:
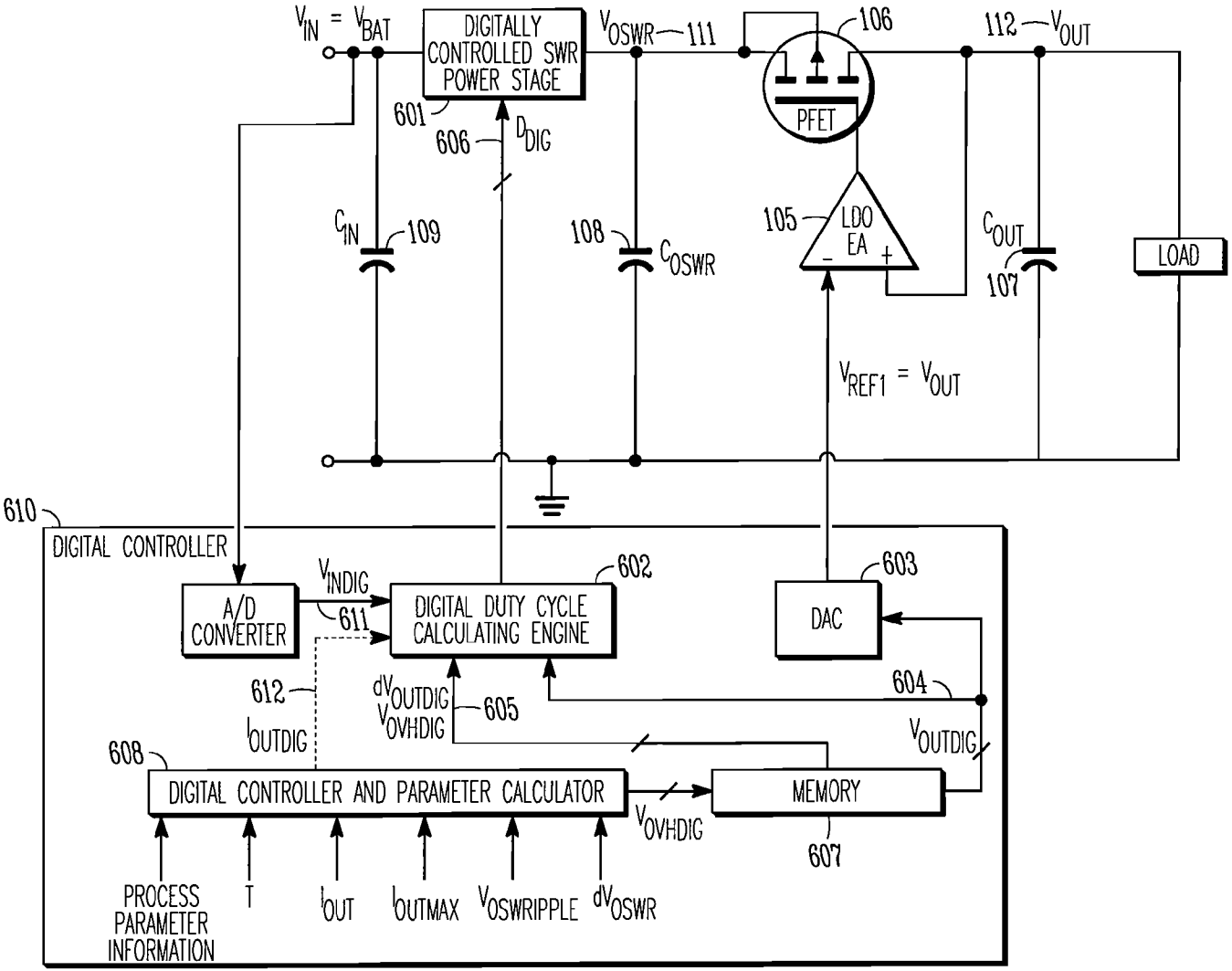
FIG. 6 shows another embodiment of the invention with digital control.

FIG. 6 shows yet another embodiment of the invention, utilizing digital control. The analog controlled SWR power stage 101 of FIGS. 4 and 5 is replaced by digitally controlled SWR power stage 601. It is controlled by the digital value of the duty cycle Ddig on line 606, generated by digital controller 610. Digital controller 610 and parameter calculator 608 have access to various parameters influencing the value of Vovh. It uses the process parameter values, the temperature reading T, Ioutmax, Voswrripple, dVoswr, and optionally Iout, to calculate the digital value of Vovh and store it in memory 607. Typically this calculation does not have to be done very often and at high speed, as the parameters used are either constant for one implementation, such as the process parameters, or change slowly, such as the temperature T. If the actual varying value of Iout is not used, most of these calculations may be performed off-line, such as by a computer subroutine that is running on the test equipment computer and not part of the hardware of the regulators. This may be especially true for the calculation of the process parameter variation dependent components of Vdsmin, which requires non-linear calculations that may take significant die area if implemented on the regulator integrated circuit. If Vovh, or some of its components, are pre-calculated during test, they may be stored in memory 607 of digital controller 610, which may be non-volatile.

Digital duty cycle calculating engine 602 uses the digital value of Vovh, Vovhdig, the digital value of the tolerance of the LDO's output voltage, dvoutdig, and the digital value of the SWR's input voltage, Vindig, that is generated by Analog to Digital Converter (A/D converter) 609 to calculate the digital duty cycle value Ddig that generates the appropriate Voswr. In one embodiment, this control is open loop, no feedback from Voswr is used by the digital controller. This is facilitated by operating the SWR power stage 601 in continuous current mode, where there is a direct relationship between the SWR's output voltage Voswr, input voltage Vin, and duty cycle that is first order independent of the output (load) current. Because of the lack of feedback, the load regulation of the SWR that is part of the value dVoswr is larger than in typical feedback controlled systems.

If for some reason continuous current mode operation is not appropriate, digital duty cycle calculating engine 602 may use the real-time output current value in digital form, e.g., Ioutdig 612, to calculate the duty cycle. Unless the output current is constant or slowly changing, the digital controller and parameter calculator 608 should be a real-time calculating engine. The different inputs into digital controller and parameter calculator 608 are either available within the system in digital form, or if they are only available in analog form, an A/D converter (not shown) may be used to convert the analog quantities, such as temperature T and current Iout, to digital values.

In the embodiment of FIG. 6, the reference of the LDO is set by a digital to analog converter, DAC 603. The output voltage of the LDO, Vout, follows this digitally programmed reference voltage. The digital reference voltage value, Voutdig, is set by digital controller 610. This controller may change the Vout of the LDO for many reasons, such as to track temperature changes, Iout changes, clock rate changes in the LDO's load circuit, at the request of an intelligent load, and others. It is expected that the controller will maintain the improved high efficiency of the combined SWR-LDO regulator system by adaptively controlling Vovh at any Vout value. This is accomplished by feeding the digital value corresponding to Vout, Voutdig, on lines 604 to not only DAC 603 but also into digital duty cycle calculator 602.

Figure 7:
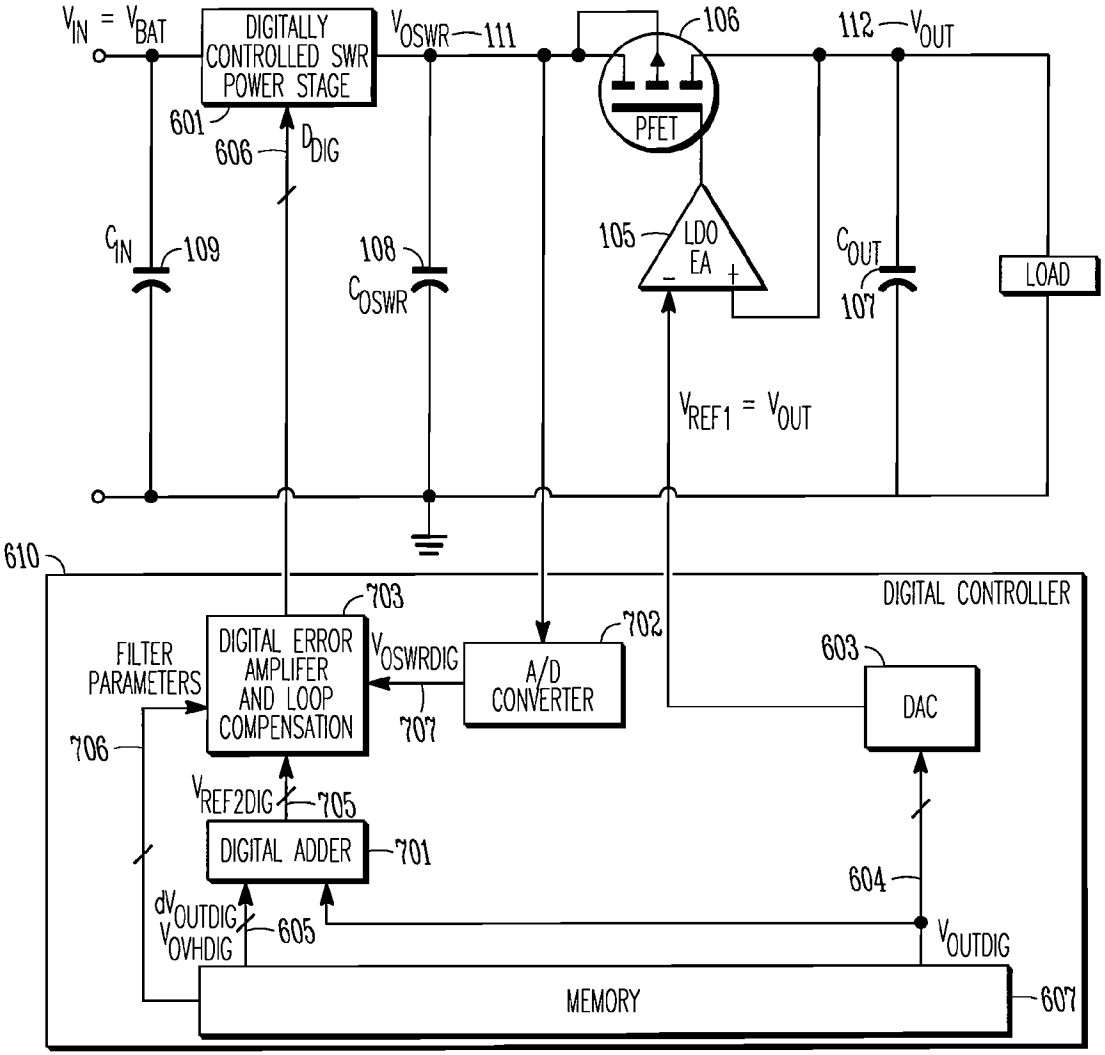
FIG. 7 shows another embodiment of the invention with digital control.

FIG. 7 shows another embodiment of the invention with digital control. This embodiment controls Voswr via feedback, in contrast with the open loop control of the embodiment shown in FIG. 6. This provides much tighter load regulation for the SWR, reducing the dVoswr term in the Vovh, and thereby increasing the efficiency.

The digital duty cycle Ddig on line 606 controls the SWR's output voltage Voswr. This is calculated by the digital error amplifier and loop compensation block 703. It adjusts the Voswr to force its two digital inputs, Voswrdig 707 and Vref2dig 705, to the same value, or very close to the same value. Voswrdig is generated by A/D converter 707. This is the digitized value of the output voltage Voswr of the SWR. Vref2dig is generated by digital adder 701. It generates this value by adding Vovhdig and dvoutdig on lines 605 to the digital value of Voutdig on lines 604.

In the embodiment of FIG. 7, the reference of the LDO is set by a digital to analog converter, DAC 603. The output voltage of the LDO, Vout, follows this digitally programmed reference voltage. The digital reference voltage value, Voutdig, is set by digital controller 610 . The controller may change the Vout of the LDO for many reasons, such as to track temperature changes, Iout changes, clock rate changes in the LDO's load circuit, at the request of an intelligent load, and others. It is expected that the controller will maintain the improved high efficiency of the combined SWR-LDO regulator system by adaptively controlling Vovh at any Vout value. This is accomplished by feeding the digital value corresponding to Vout, Voutdig, on lines 604 to not only the DAC 603 but also into digital adder 701.

Vref2dig is the digital form of the reference voltage of the SWR. Digital error amplifier and loop compensation block 703 takes these two digital values, digitally amplifies the difference, and applies digital filtering to it. This digital filtering provides the loop filter function so as to make the SWR's closed digital control loop stable.

The digital values of Vovhdig and dvoutdig are stored in memory 607. These values are stored by a digital controller and parameter calculator engine (not shown), which in one embodiment may be similar to engine 602 of FIG. 6. As discussed above, this block may or may not be part of the regulator hardware.

Figure 8:
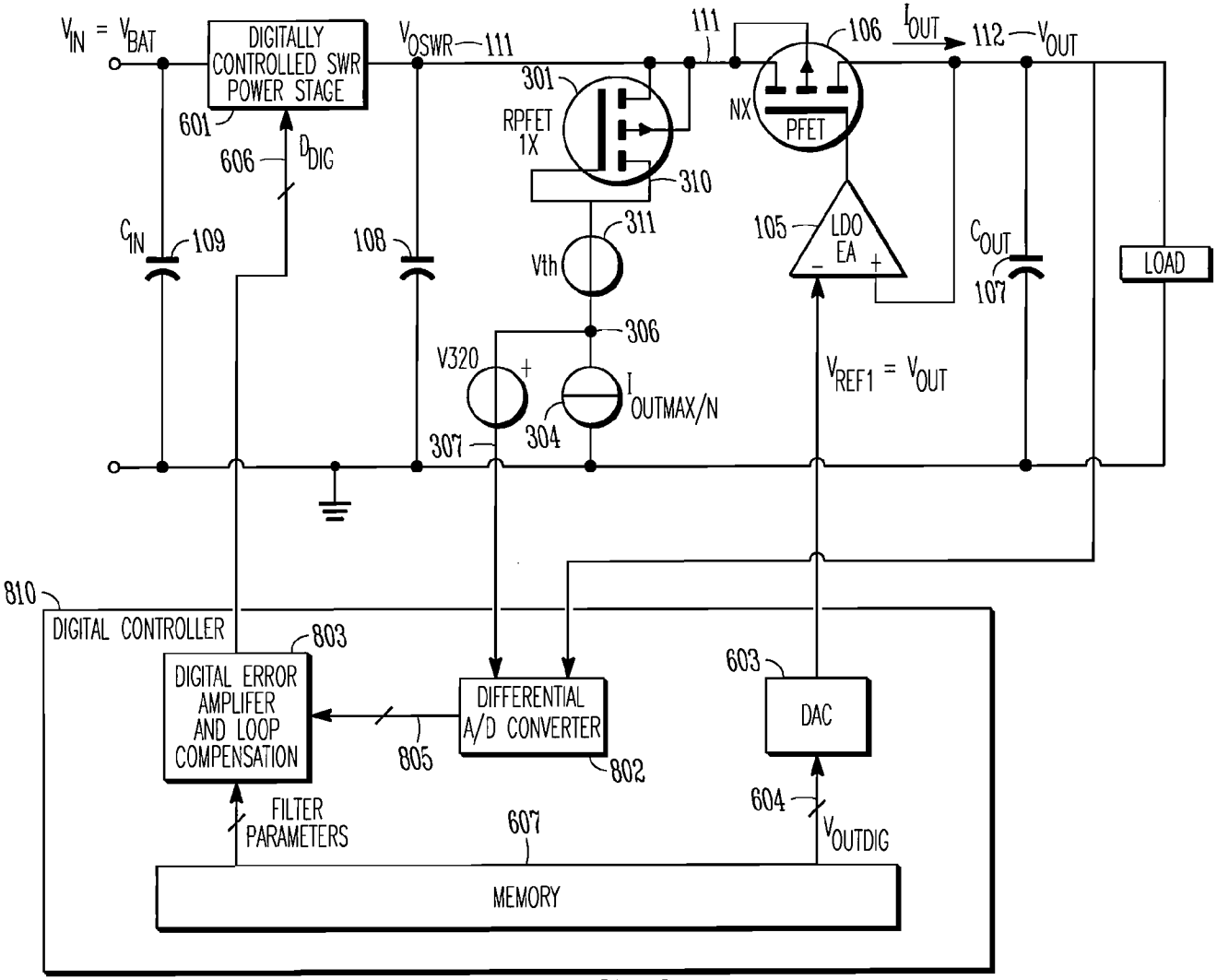
FIG. 8 shows another embodiment of the invention with digital control.

FIG. 8 shows another embodiment of the invention using digital control. It is the digital implementation of the embodiment shown in FIG. 4. The differential A/D converter 802 digitizes the difference of Vout and the voltage on node 307, which is Voswr−Vovh. Digital error amplifier and loop compensation block 803 amplifies and filters this digital difference value and forces it to zero, or close to zero, by adjusting the Voswr by controlling the digital duty cycle Ddig of the SWR on lines 606.

An advantage of this embodiment is that it uses differential A/D converter 802 that does not need to be very accurate or have very high resolution, because its output always varies around zero. Another advantage of this embodiment is that it does not need a digital representation of Vovh and its components, making the digital part of the circuit much simpler.

In the embodiment of FIG. 8, the reference of the LDO is set by a digital to analog converter, DAC 603. The output voltage of the LDO, Vout, follows this digitally programmed reference voltage. The digital reference voltage value, Voutdig, is set by digital controller 610. The controller may change the Vout of the LDO for many reasons, such as to track temperature changes, Iout changes, clock rate changes in the LDO's load circuit, at the request of an intelligent load, and others. It is expected that the controller will maintain the improved high efficiency of the combined SWR-LDO regulator system by adaptively controlling Vovh at any Vout value. This is due to the fact that differential A/D converter 802 uses the actual Vout, programmed by Voutdig, as one of its inputs.

In battery operated handheld systems, such as cellular phones, PDAs (personal digital assistants), digital still cameras, and so forth, there are a relatively large and number of voltage rails, requiring a relatively large number of voltage regulators. High efficiency operation of these regulators is paramount for long battery life. Wherever relatively large current and large input-output voltage difference is needed, or in cases where up-conversion is needed, switching regulators or charge pumps are often used. However, as switching regulators are relatively expensive and large, wherever possible linear low drop out regulators, LDOs, are often used. As discussed previously, combining a switching regulator and an LDO in a cascade fashion yields a high efficiency regulator system that also exhibits the low ripple, low noise, and fast transient response advantages of linear regulators. But combining a switching regulator with every LDO may not be economical.

Accordingly, embodiment voltage regulators are described that combine a front end switching regulator with a number of LDOs, all operated from the output of the same SWR, in such a way that the combined system has improved efficiency by adaptively controlling the output voltage of the switching regulator based on the combined overhead needs of all the LDOs operated from its output voltage. It is expected that embodiments provide improved overhead and efficiency over process variation, junction temperature variation, output current variation, external component value ranges, pass device sizes, varying LDO output voltages (Vouts), and LDO output currents (Iouts). It is expected that the described embodiments preserve the advantages of the LDO regulators, especially their low output ripple voltage and fast load transient response. Some or all of the described embodiments generate the overhead voltage Vovh for all the LDOs in an adaptive way so as to track process parameter variations, temperature variations, output current (e.g., load current) variation, and calculate the minimum switching regulator output voltage, Voswr, that satisfies the overhead requirements of all the LDOs.

Embodiments with both analog and digital control are described. An advantage of the digitally controlled embodiments is that they provide programmability and flexibility. They also enable the adjustment and optimization of the overhead in every individual integrated circuit by measuring parameters on each individual unit during test, and allow for adjusting the digitally stored parameters in the digital controller's non-volatile memory for minimal improved overhead.

As discussed for the previous embodiments, the SWR power stage 601 may be buck, boost, or buck-boost topology, depending on the required value of Voswr relative to the Vin (e.g., battery voltage range at the input of the SWR). It may also represent a regulated high efficiency charge pump, in standard or fractional implementation.

Figure 9:
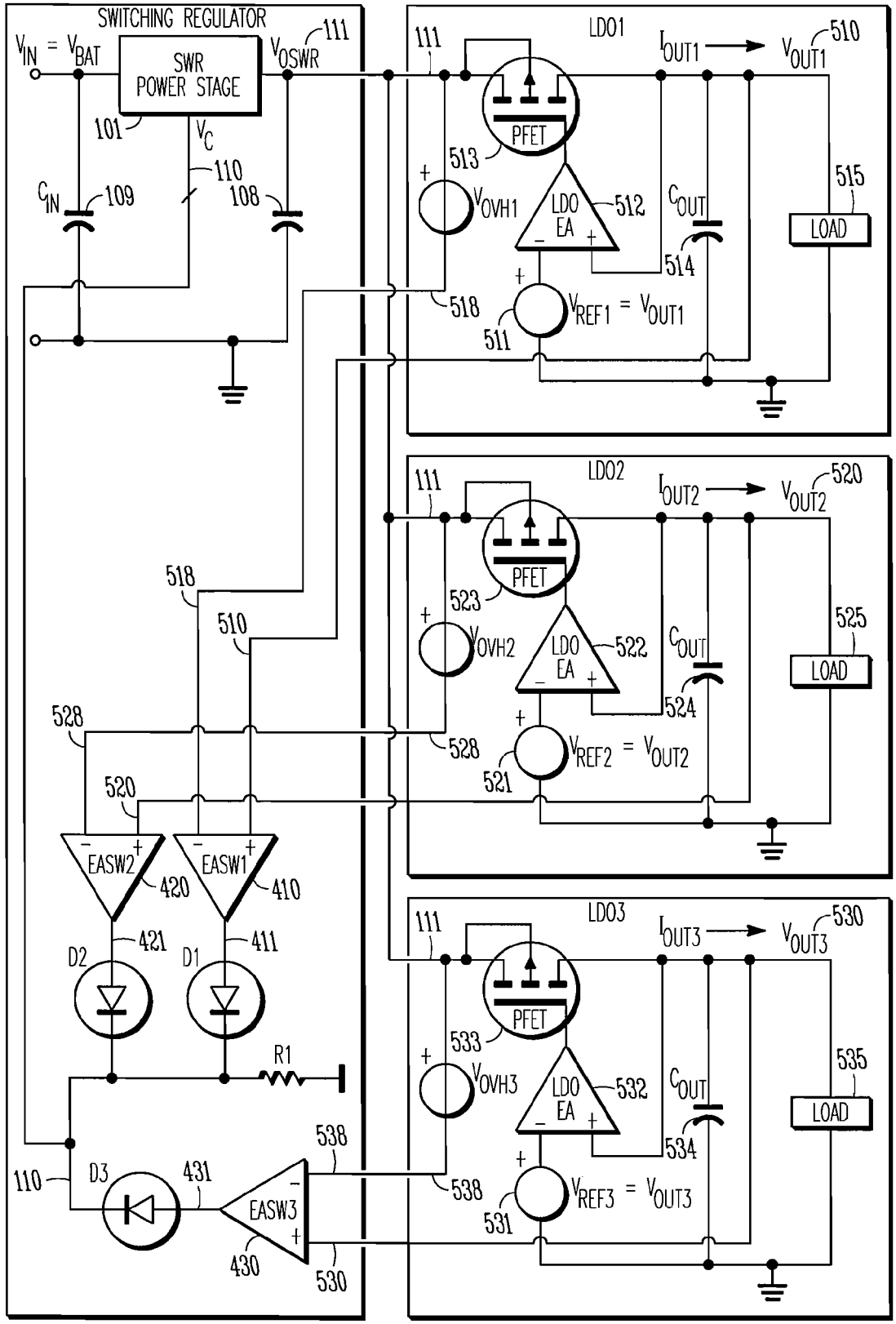
FIG. 9 shows a the block diagram of one embodiment of the invention with one SWR and three LDOs.

FIG. 9 shows one embodiment of the invention, using analog control. The block diagram shows a system with one switching regulator feeding three LDOs. It is straightforward for those experienced in the art to extend this block diagram to any number of LDOs. The output of the SWR, Voswr, is controlled via the Vc control voltage on line 110. The voltage on line 110 is controlled by the highest output voltage of error amplifiers 410, 420, and 430. Each of these error amplifiers belong to one of the LDOs. They amplify the difference between the Vout of the LDO and its difference Vin−Vovh, i.e., Vout(i) and Vin(i)−Vovh(i). As Vin(i) is the same (Voswr) for all LDOs, this corresponds to amplifying the difference of Vout(i) and Voswr−Vovh(i). This corresponds to the difference between the voltages on nodes 510 and 518 for LDO1, nodes 520 and 528 for LDO2, and nodes 530 and 538 for LDO3.

The combined system is expected to be stable and in equilibrium if Voswr−Vovh(i)≧Vout(i) for all three regulators. Expressing Voswr as the dependent variable, this relationship becomes Voswr≧Vout(i)+Vovh(i). Each of the three error amplifiers ensure that this relationship is held for its corresponding LDO. The error amplifier that corresponds to the LDO with the highest Vout(i)+Vovh(i) requires the highest Voswr. It controls the switching regulator output by controlling the voltage on line 110 via the analog "OR" connection of the outputs of the error amplifiers realized by the three diodes Dl, D2, and D3 and resistor R1. The diode connected to the controlling error amplifier is forward biased, while the other two diodes are reverse biased and their corresponding error amplifiers are inactive and in negative saturation. For the LDO with the controlling error amplifier, Voswr=Vout(i)+Vovh(i) (under ideal conditions). For all the other LDOs, it is Voswr>Vout(i)+Vovh(i).

The transfer of control between the three error amplifiers is continuous and smooth. If for instance the load on one LDO that was not in control were to increase, thereby increasing its Vovh, and it now requires higher Voswr, the output voltage on its error amplifier will move higher than the output voltage of the error amplifier that was in control and it will raise the voltage on line 110 (via its serial diode), which in turn will increase the Voswr.

The analog "OR" function, realized by Dl, D2, D3 and R1 in FIG. 9, may be implemented in a number of different ways, as it is know in the art. Any suitable implementation of the analog "OR" function may be used.

In FIG. 9, the Vovh(i) overhead voltages (where i is an index, e.g., Vovh1, Vovh2, and Vovh3 in FIG. 9) are represented by ideal voltage sources. But in practice, some kind of circuit implementation is incorporated. It is to be understood that both constant and adaptive overhead voltage implementations are applicable. For example, the Vovh(i) overhead voltages may be realized by the replica transistors and other current sources as described in the embodiments of FIG. 4*a*, FIG. 4*b*, and FIG. 5. However, other sub-circuit implementations of these ideal overhead voltages may be implemented.

Figures 10, 10A:
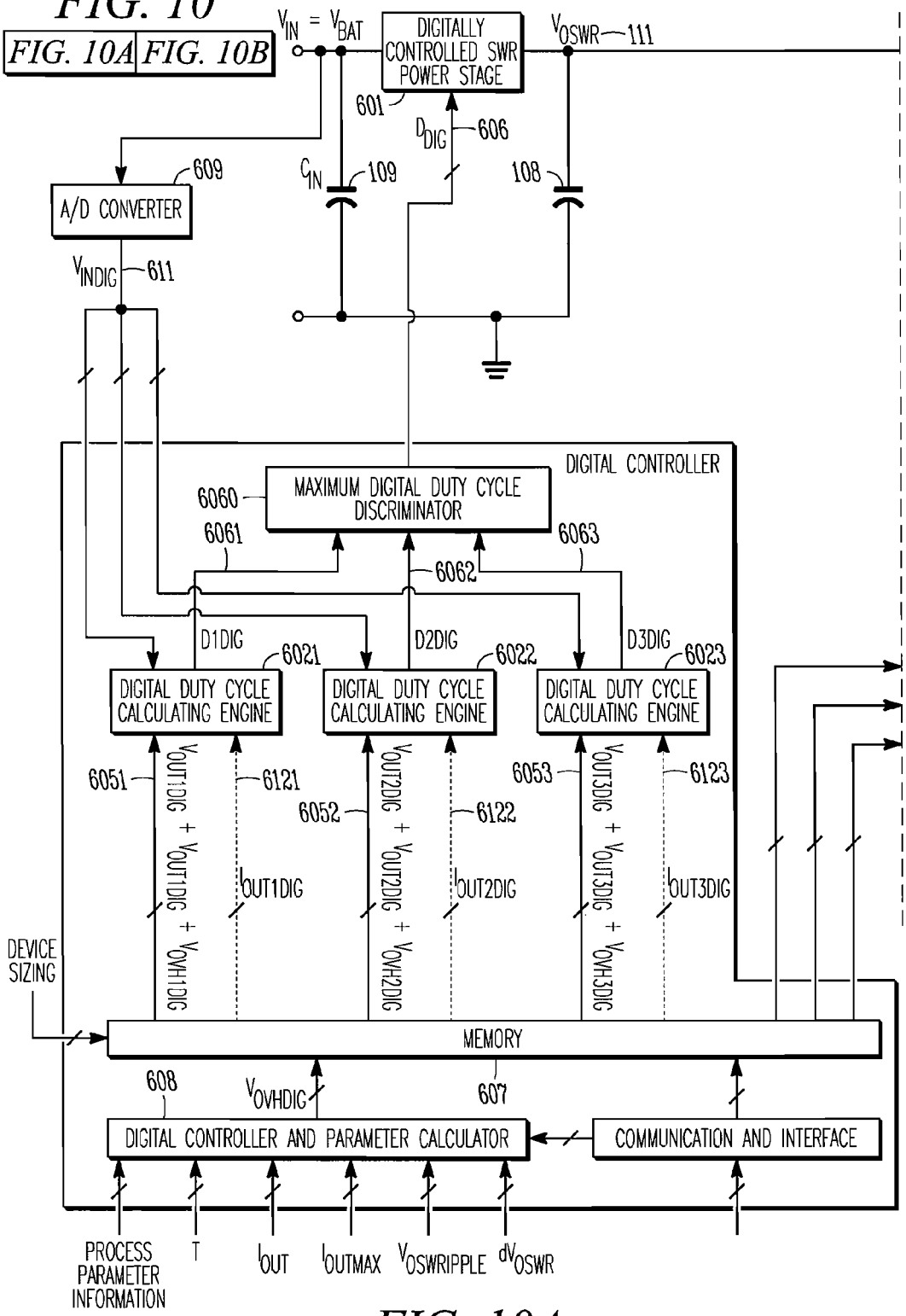
FIG. 10 shows the block diagram of another embodiment of the invention with one SWR and three LDOs with digital control
Figure 10B:
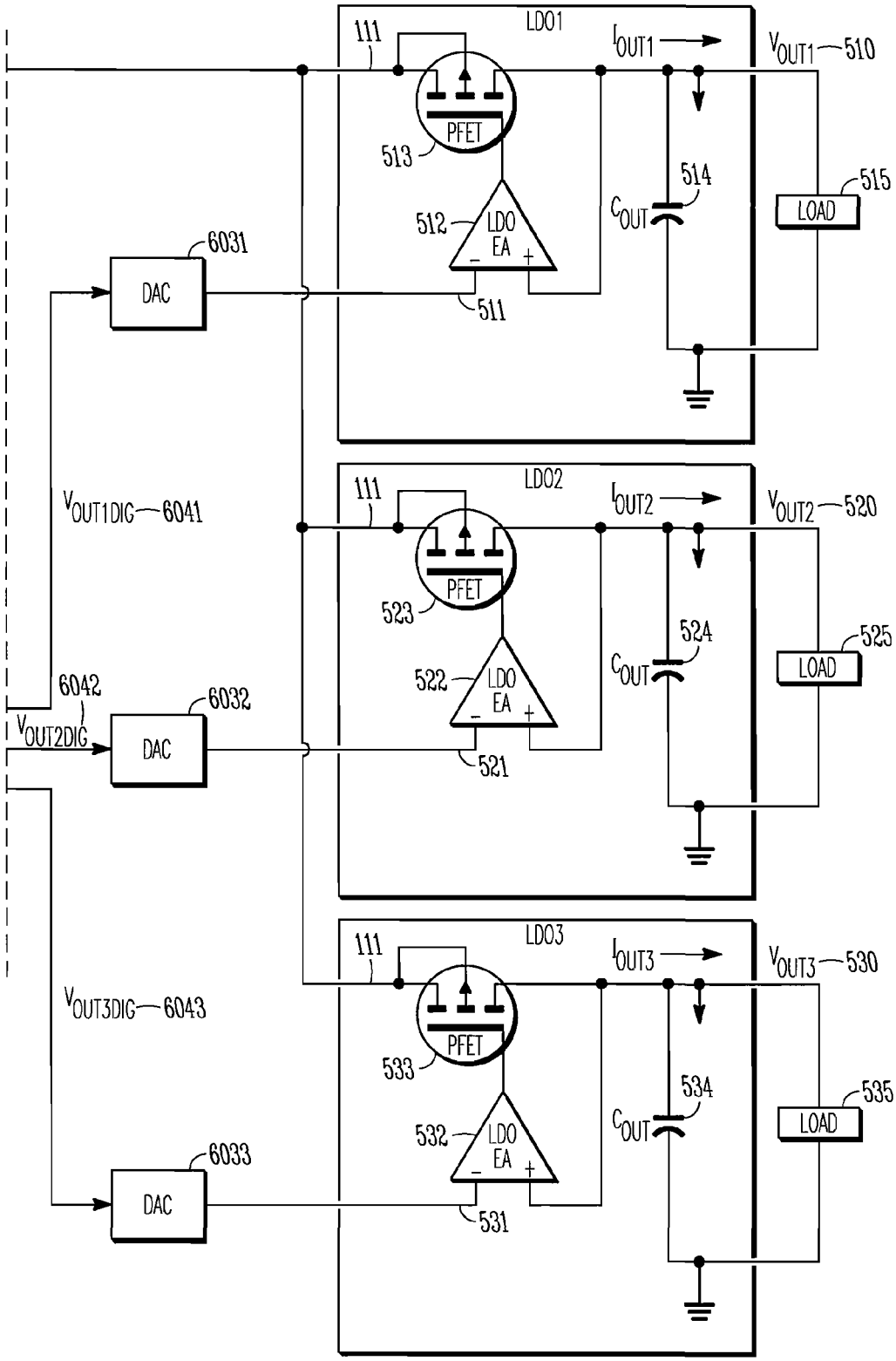

FIG. 10 shows another embodiment of the invention utilizing digital control. This embodiment may be viewed as the multi-LDO extension of the SWR-single LDO circuit shown in FIG. 6. The digitally controlled SWR power stage is controlled via the digital duty cycle signal, Ddig, on line 606. The value of the digital duty cycle Ddig is set by the highest of the duty cycle values generated by the three digital duty cycle calculating engines 6021, 6022 and 6023. Each of these duty cycle calculating engines calculate the digital duty cycle value corresponding to the Vout and Vovh of one of the LDOs. They use the sum of the Vout(i)dig, dVout(i)dig, and Vovh(i) dig values, and optionally the Iout(i)dig value, to calculate the digital duty cycle for the SWR corresponding to an SWR output voltage, Voswr, that satisfies the condition of improved efficiency with minimal overhead operation for each LDO. Maximum duty cycle discriminator block 6060 selects the highest of the three digital duty cycle values generated by calculating engines 6021, 6022 and 6023, and this highest value sets the duty cycle and corresponding Voswr for the SWR. This Voswr satisfies the requirements of the LDO with the highest Vout+Vovh value and operates the rest of the LDOs with higher than optimal overhead, Vovh. This Voutswr is the lowest (optimal) value for the SWR-3 LDO voltage regulator system.

It is to be understood that there are many ways to implement the combined digital duty cycle calculating engine (comprising blocks 6021, 6022, 6023), and maximum duty cycle discriminator (6060) functions. For example, one digital duty cycle calculating engine function may be multiplexed and shared between multiple LDOs, and combined via a small digital state machine and some memory to generate the maximum duty cycle used to control the SWR. All the different partitioning and physical implementations of these functions are applicable for this embodiment of the invention.

The digital values needed to calculate Vovh and the duty cycle are stored in the memory, which may be non-volatile. Digital controller and parameter calculator block 608 calculates and generates these digital values from the process parameter information, temperature information, Iout(i), Ioutmax(i), Voswrripple, dVoswr, and device sizing information. These are either available in the system in digital form, or are digitized via an analog to digital converter that is not shown. The function of block 608 may be part of the voltage regulator system, or it may be accomplished by software running on an external computer and the data loaded into memory 607 via the serial interface during IC testing, or at another point in the manufacturing process, or perhaps in real time during system start-up or during normal operation.

Figures 11, 11A, 11B:
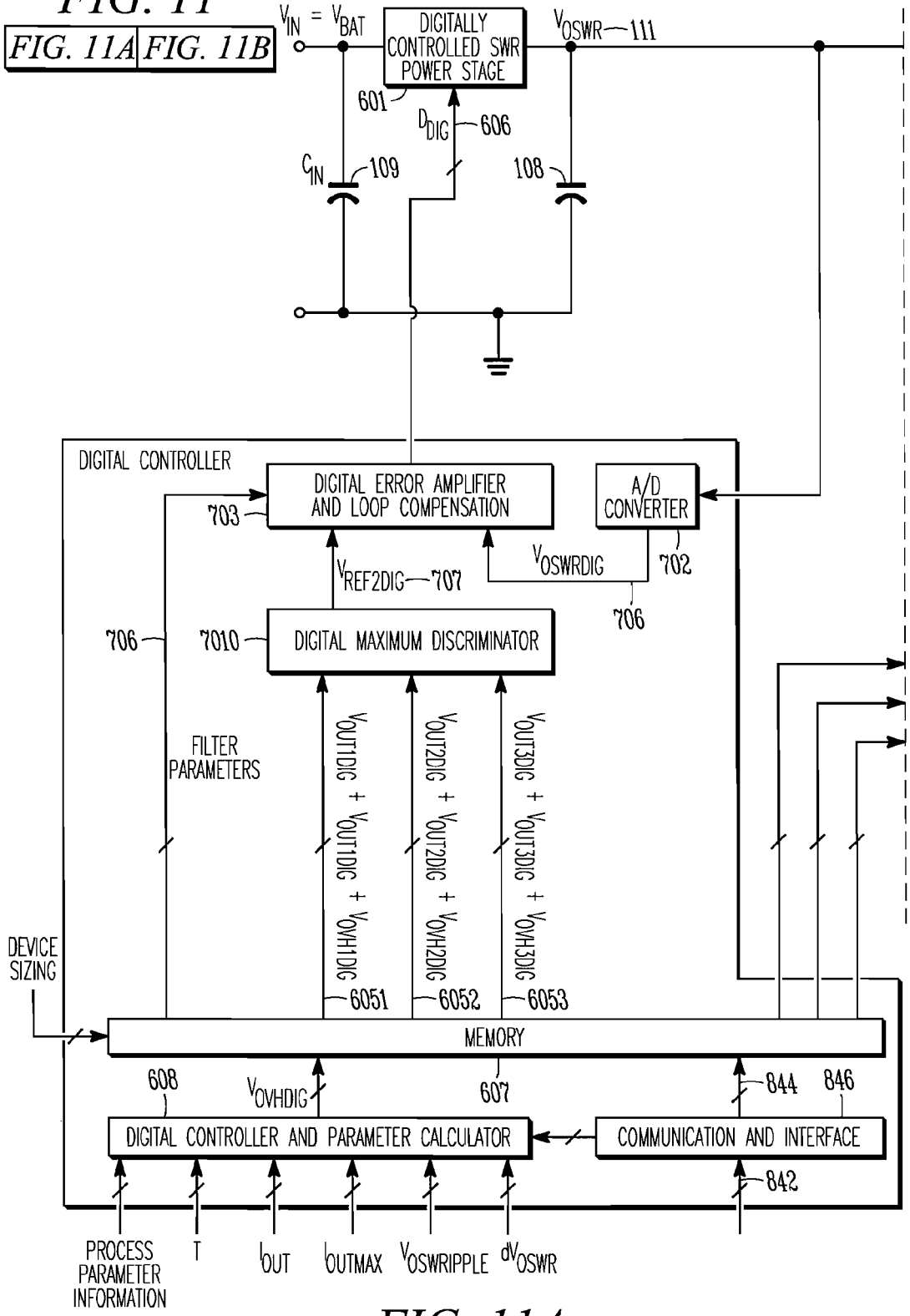
FIG. 11 shows another embodiment of the invention with one SWR and three LDOs with digital control
Figure 11B:
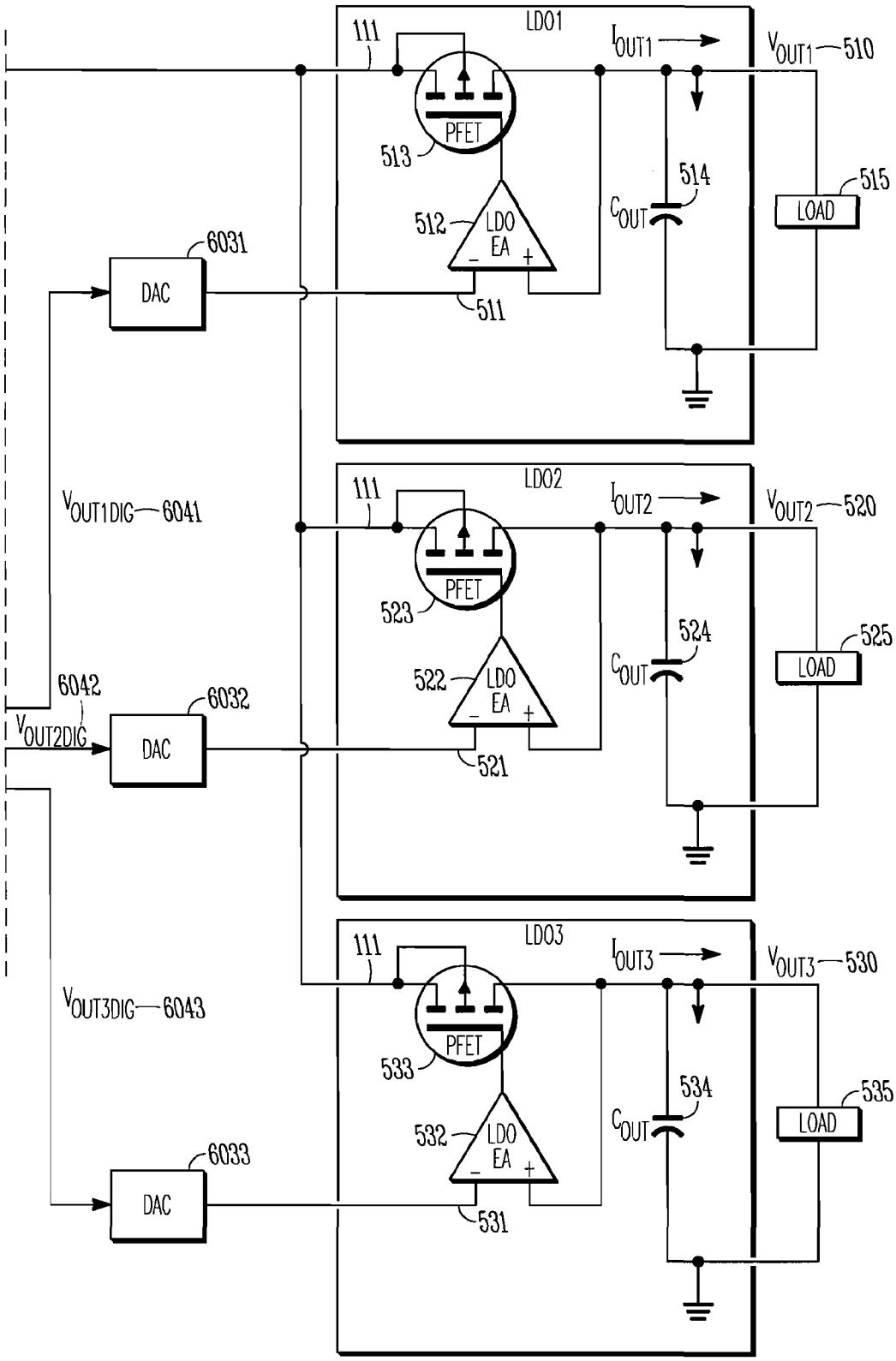

FIG. 11 is an alternative embodiment of the invention using digital control. It may be viewed as the multi-LDO extension of the SWR-single LDO circuit shown in FIG. 7. In this embodiment, memory 607, which may be non-volatile, contains the information needed to calculate the reference voltage value of the SWR in digital form, Vref2dig, for the digital control loop. Digital maximum discriminator block 7010 takes the quantity (Vout(i)dig+dVoit(i)dig+Vovh(i)dig) for all LDOs from memory 607, and chooses the highest of them which corresponds to the Vref2dig value, the digital reference voltage of the SWR, on line 707. Digital error amplifier and loop compensation block 703 compares this Vref2dig value and the digitized output voltage of the SWR, Voswrdig on line 706, and amplifies and filters the difference to generate the digital duty cycle value Ddig on line 606. This digital duty cycle value controls the output voltage of digitally controlled SWR power stage 601. Voswrdig is generated by A/D converter 702.

Digital to analog converters, DACs 6031, 6032 and 6033, provide the digitally controlled reference voltages of the LDOs. These may be changed in real time, dynamically by the regulator system's on-chip controller (not shown), or via the serial interface 842 from an outside controller. If any of the LDO output voltages is changed via lines 6041, 6042, or 6043, the appropriate value on the corresponding line 6051, 6052, or 6053, also changes. This in turn may change the Vref2dig value and generate a new Voswr via block 703 that yields improved efficiency for the new set of LDO output voltages. This embodiment automatically adjusts Voswr to dynamically track the operating conditions of the LDOs, both Vout and Iout, to improve the overall efficiency of the regulator system.

Figures 12, 12A:
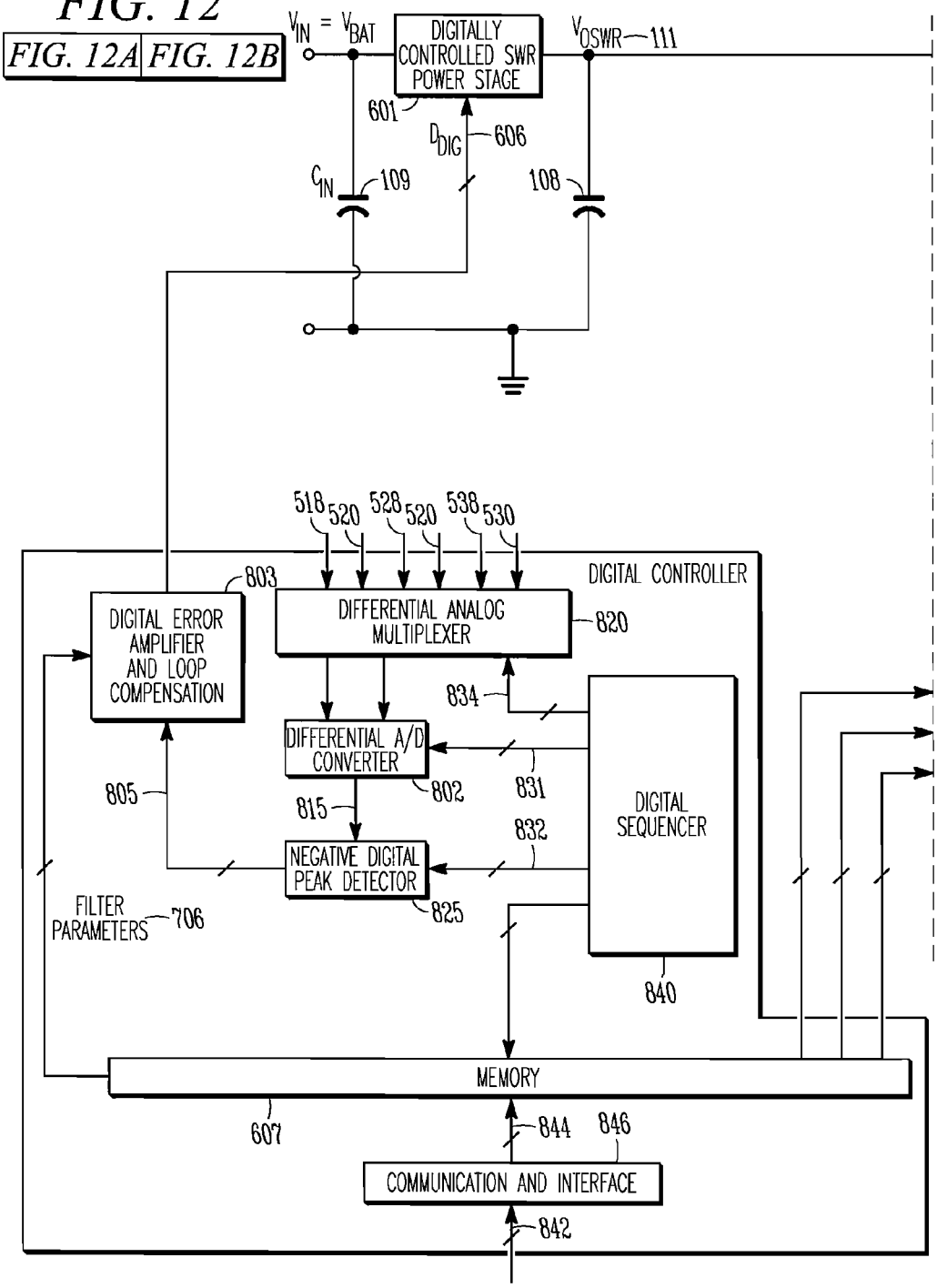
FIG. 12 shows another embodiment of the invention with one SWR and three LDOs with digital control.
Figure 12B:
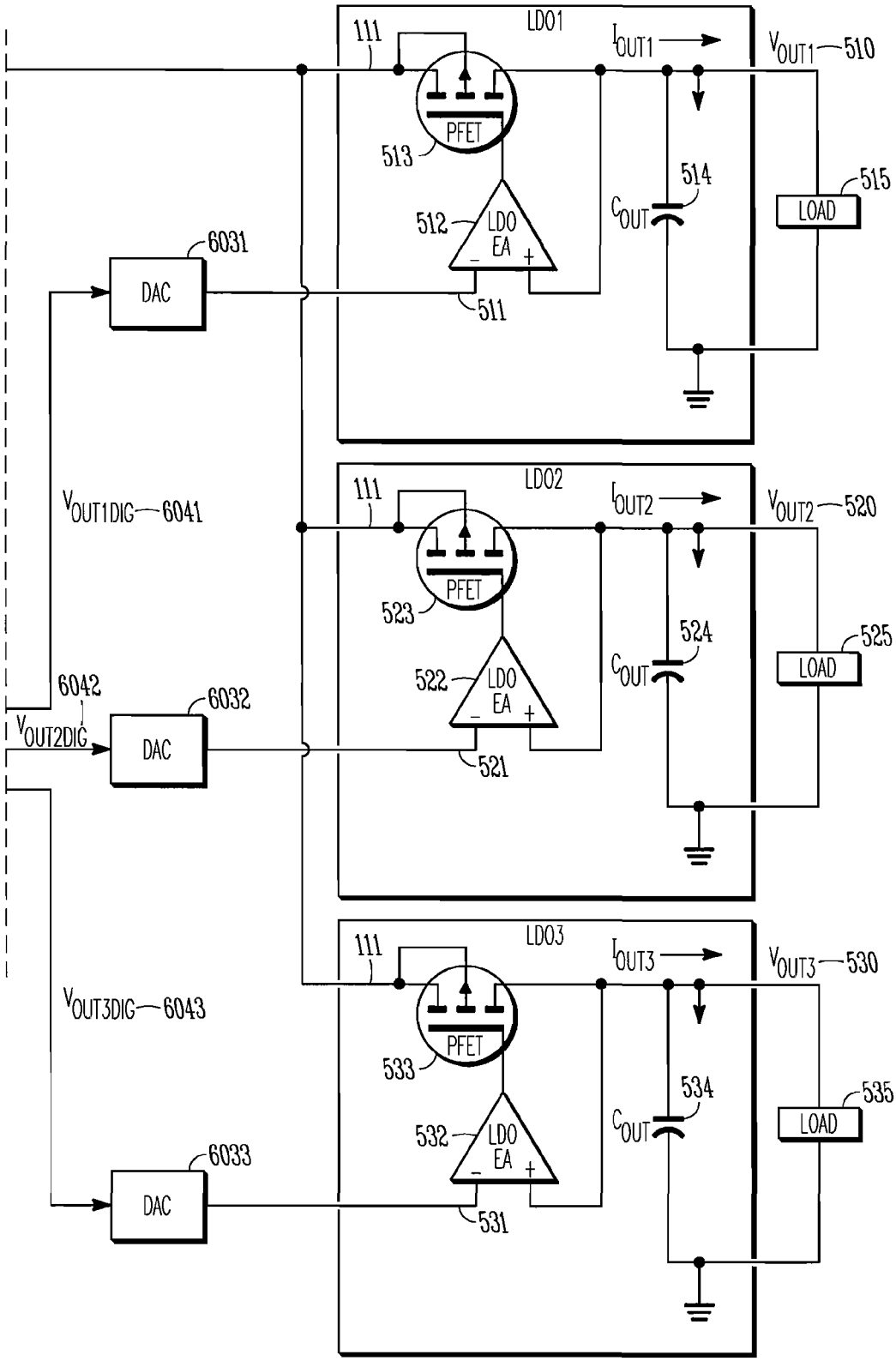

FIG. 12 shows another embodiment of the invention utilizing digital control. This embodiment may be viewed as the multi-LDO extension of the SWR-single LDO circuit shown in FIG. 8.

Differential A/D converter 802 digitizes the difference of (Voswr-Vovh(i)) and Vout(i) for all LDOs in a multiplexed fashion. The multiplexing is accomplished by differential analog multiplexer 820 under the control of digital sequencer 840. Negative peak detector 825 chooses the most negative of these digital values, which corresponds to the highest Voswr requirement among the LDOs, and feeds it to digital error amplifier and loop compensation block 803. Its output 606 provides the digital duty cycle value, Ddig, for the digitally controlled SWR power stage 601.

In equilibrium, when the Voswr is in steady state and regulated, the value of the input to digital error amplifier and loop compensation block 803 on line 805, and on its input on line 815, is approximately zero. This means that the loop regulates to (Voswr-Vovh(i))−(Vout(i))=0, corresponding to Voswr=Vout(i)+Vovh(i), for the LDO that requires the highest Voswr. For all the other LDOs, the output of A/D converter 802 on line 815 is positive.

If the operating conditions of the LDOs change, either by a change in their programmed output voltage via the DACs, 3031, 3032 or 3033, or their output current changes, the loop automatically regulates the Voswr according to the needs of the LDO requiring the highest Voswr value.

An advantage of the embodiment of FIG. 12 is that differential A/D converter 802 may be a low cost low accuracy converter without compromising the accuracy of Voswr. Also, if the LDOs' output voltages are not changed with high frequency, which is typically the case, the A/D converter does not need to be high speed either, further reducing its complexity, size and cost.

It is to be understood that in FIG. 12, the overhead voltages Vovh(i) are shown as analog voltage sources. These voltage sources may be implemented in many different ways, where some implementations are shown in FIGS. 4*a*, 4*b*, and 5, but need not be limited to such implementations.

It is understood that the embodiment of FIG. 12 may be partitioned in different ways. One embodiment may accomplish the negative peak detector function in an analog manner in front of the A/D converter, replacing negative digital peak detector block 825 with an analog block and eliminating differential analog multiplexer 820. Other possible partitions are also applicable.

Some of the functional blocks described with respect to the above embodiments may be realized by hardwired circuits, programmable circuits, or processors running software or firmware. Some of the functional relationships described with respect to the above embodiments may be abstracted by the flow diagrams of FIGS. 13 and 14.

Figure 13:
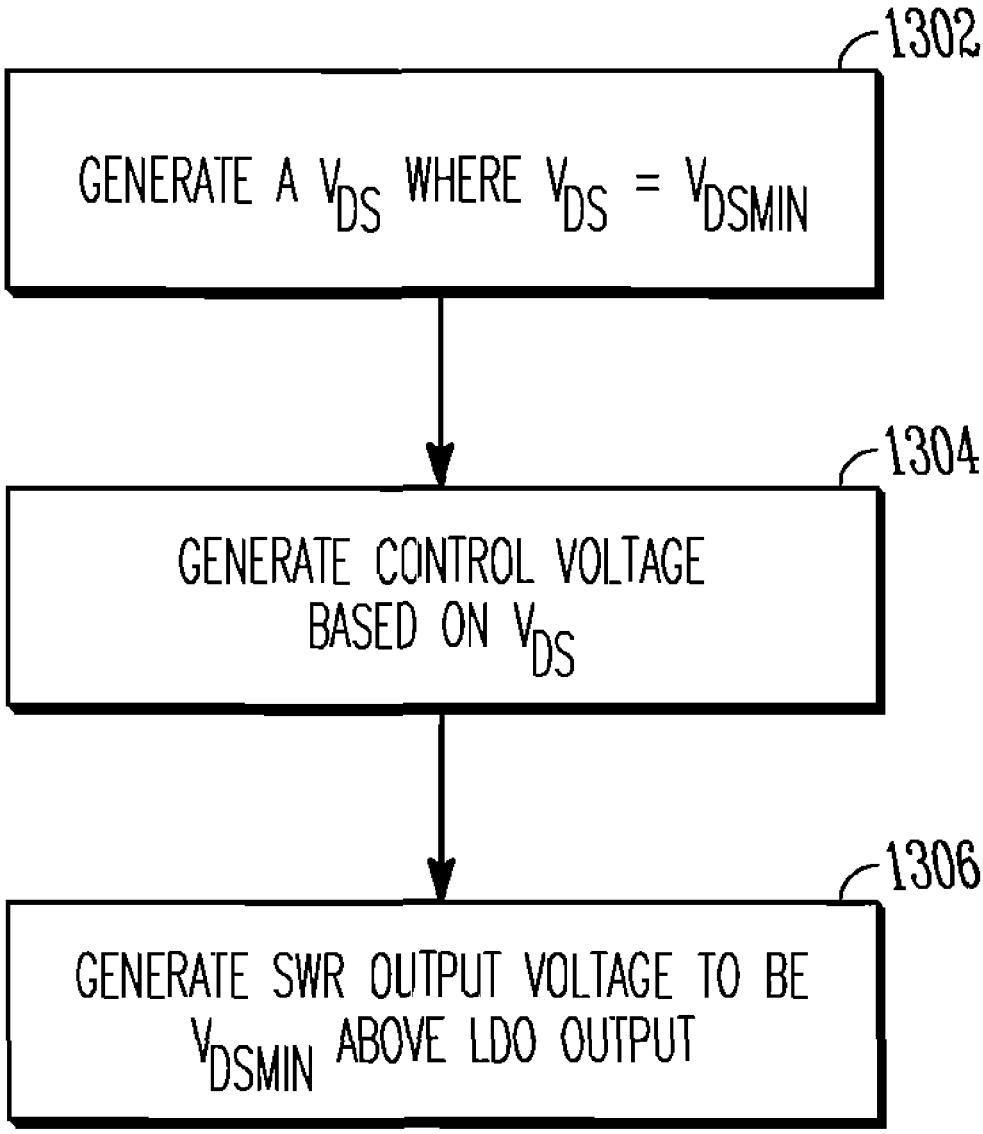
FIG. 13 is a flow diagram illustrating an embodiment of the invention.

In FIG. 13, block 1302 indicates that a voltage, e.g., Vds, is generated to equal the minimum drain-to-source voltage of a pass transistor, Vdsmin, operating in its saturated operating mode. In block 1304, a control voltage is generated based upon the voltage generated in block 1302. In block 1306, the control voltage is used to control the output voltage of a voltage regulator, such as a SWR, to have an output voltage Vdsmin above the output voltage of another voltage regulator, such as a LDO.

Figure 14:
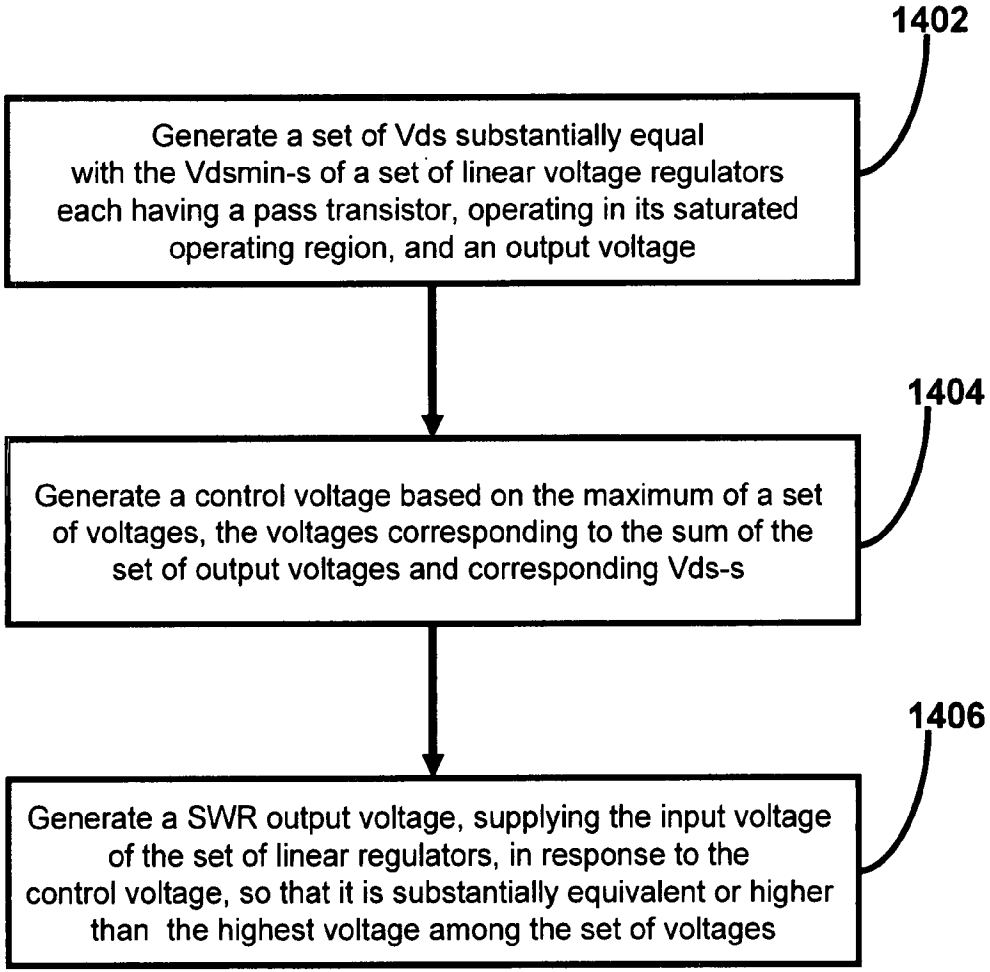
FIG. 14 is a flow diagram illustrating another embodiment of the present invention.

In FIG. 14, block 1402 indicates that a first set of voltages is generated, where each generated voltage in the set is substantially equal to the minimum drain-to-source voltage of a pass transistor in a set of pass transistors when operating in its saturated operating mode. Each pass transistor belongs to a linear voltage regulator having an output voltage and a common input voltage. In block 1404, a control voltage is generated based upon the maximum of a second set of voltages, generated in block 1402, added to the corresponding linear regulator output voltages. In block 1406, the control voltages is used to set the output voltage of a voltage regulator, such as a SWR, that provides the common input voltage of the linear regulators, to be at least equal or higher than the maximum of the second set of voltages.

Various modifications may be made to the disclosed embodiments without departing from the scope of the invention as claimed below. For example, the disclosed embodiments utilized PFET transistors for the pass transistor and the replica transistor. However, duals to these embodiments may be realized and are straightforward modifications of the disclosed embodiments, in which NFETs replace the described PFETs.

It is to be understood in these letters patent that the meaning of "A is connected to B", where A or B may be, for example, a node or device terminal, is that A and B are connected to each other so that the voltage potentials of A and B are substantially equal to each other. For example, A and B may be connected by way of an interconnect, for example. In integrated circuit technology, the interconnect may be exceedingly short, comparable to the device dimension itself. For example, the gates of two transistors may be connected to each other by polysilicon or copper interconnect that is comparable to the gate length of the transistors. As another example, A and B may be connected to each other by a switch, such as a transmission gate, so that their respective voltage potentials are substantially equal to each other when the switch is ON.

It is also to be understood in these letters patent that the meaning of "A is coupled to B" is that either A and B are connected to each other as described above, or that, although A and B may not be connected to each other as described above, there is nevertheless a device or circuit that is connected to both A and B. This device or circuit may include active or passive circuit elements, where the passive circuit elements may be distributed or lumped-parameter in nature. For example, A may be connected to a circuit element which in turn is connected to B.

It is also to be understood in these letters patent that a "current source" may mean either a current source or a current sink. Similar remarks apply to similar phrases, such as, "to source current".

It is also to be understood in these letters patent that various circuit blocks, such as current mirrors, amplifiers, etc., may include switches so as to be switched in or out of a larger circuit, and yet such circuit blocks may still be considered connected to the larger circuit because the various switches may be considered as included in the circuit block.

Various mathematical relationships may be used to describe relationships among one or more quantities. For example, a mathematical relationship or mathematical transformation may express a relationship by which a quantity is derived from one or more other quantities by way of various mathematical operations, such as addition, subtraction, multiplication, division, etc. Or, a mathematical relationship may indicate that a quantity is larger, smaller, or equal to another quantity. These relationships and transformations are in practice not satisfied exactly, and should therefore be interpreted as "designed for" relationships and transformations. One of ordinary skill in the art may design various working embodiments to satisfy various mathematical relationships or transformations, but these relationships or transformations can only be met within the tolerances of the technology available to the practitioner.

Accordingly, in the following claims, it is to be understood that claimed mathematical relationships or transformations can in practice only be met within the tolerances or precision of the technology available to the practitioner, and that the scope of the claimed subject matter includes those embodiments that substantially satisfy the mathematical relationships or transformations so claimed.

What is claimed is:

1. A circuit comprising:

a first regulator comprising an output port to provide an output voltage in response to a control voltage;

a second regulator comprising a pass transistor coupled to the first regulator, the pass transistor comprising a source coupled to the output port of the first regulator, and a drain coupled to the output port of the second regulator;

a transistor comprising a source coupled to the source of the pass transistor, and a drain;

a node;

a first voltage circuit to provide a first voltage difference between the drain of the
transistor and the node;

a comparator circuit comprising an output port to provide the control voltage, a first input port coupled to the drain of the pass transistor, and a second input port; and a second voltage circuit to provide a second voltage difference between the node and the second input port of the comparator circuit.

2. The circuit as set forth in claim 1, the transistor having a source-drain current, the circuit further comprising a current source to set the source-drain current of the transistor.

3. The circuit as set forth in claim 2, wherein the pass transistor is matched to the transistor.

4. The circuit as set forth in claim 3, wherein the pass transistor has a channel width to channel length ratio and the transistor has a channel width to channel length ratio different from that of the pass transistor.

5. The circuit as set forth in claim 2, the pass transistor having a source-drain current, the circuit further comprising a current sense element to sense the source-drain current of the pass transistor, wherein the current source is a current-controlled current source controlled by the current sense element.

6. The circuit as set forth in claim 5, wherein the pass transistor is matched to the transistor.

7. The circuit as set forth in claim 6, wherein the pass transistor has a channel width to channel length ratio and the transistor has a channel width to channel length ratio different from that of the pass transistor.

8. The circuit as set forth in claim 7, wherein the pass transistor has a channel width to channel length ratio N times that of the transistor; and the current sense element sets the current-controlled current source to source a current 1/N of the source-drain current of the pass transistor.

9. The circuit as set forth in claim 1, the transistor comprising a gate coupled to its drain.

10. The circuit as set forth in claim 9, the transistor having a threshold voltage, wherein the first voltage difference is in magnitude substantially equal to the threshold voltage.

11. The circuit as set forth in claim 9, further comprising a current source to set a source-drain current of the transistor.

12. The circuit as set forth in claim 11, the transistor having a threshold voltage, wherein the first voltage difference is in magnitude substantially equal to the threshold voltage.

13. The circuit as set forth in claim 12, wherein the pass transistor is matched to the transistor.

14. The circuit as set forth in claim 13, wherein the pass transistor has a channel width to channel length ratio and the transistor has a channel width to channel length ratio different from that of the pass transistor.

15. The circuit as set forth in claim 14, the pass transistor having a source-drain current, the circuit further comprising a current sense element to sense the source-drain current of the pass transistor; wherein the current source is a current-controlled current source controlled by the current sense element.

16. The circuit as set forth in claim 15, wherein the transistor has a channel width to channel length ratio, and the pass transistor has a channel width to channel length ratio N times that of the transistor, where N is a number; and the current sense element sets the current-controlled current source to source a current 1/N of the source-drain current of the pass transistor.

17. The circuit as set forth in claim 16, the transistor having a threshold voltage, wherein the first voltage difference is in magnitude substantially equal to the threshold voltage.

18. The circuit as set forth in claim 1, wherein the first regulator is a switching regulator.

19. The circuit as set forth in claim 1, wherein the comparator circuit is an analog amplifier.

20. The circuit as set forth in claim 1, wherein the comparator circuit comprises a differential analog-to-digital converter comprising a first input port and a second input port;

the first input port of the differential analog-to-digital converter is the first input port of the comparator circuit; and the second input port of the differential analog-to-digital converter is the second input port of the comparator circuit.

21. The circuit as set forth in claim 20, wherein the comparator circuit further comprises a digital amplifier to provide the control voltage;

the digital amplifier comprises an input port; and the differential analog-to-digital converter comprises an output port coupled to the
input port of the digital amplifier.

22. The circuit as set forth in claim 21, the transistor comprising a gate coupled to its drain.

23. The circuit as set forth in claim 22, the transistor having a threshold voltage, wherein the first voltage difference is in magnitude substantially equal to the threshold voltage.

24. The circuit as set forth in claim 22, further comprising a current source to set a source-drain current of the transistor.

25. The circuit as set forth in claim 1, the first voltage circuit comprising:

a second transistor comprising a gate coupled to the drain of the transistor, and a
source coupled to the node.

26. The circuit as set forth in claim 25, the first voltage circuit further
comprising:

a current source coupled to the second transistor.

27. A circuit comprising:

a first regulator comprising an output port to provide an output voltage in response to a control voltage;

a second regulator including a pass transistor coupled to the regulator, the pass transistor comprising a source coupled to the output port of the regulator, a gate, and a drain coupled to the output port of the second regulator;

an error amplifier comprising a first input port coupled to the drain of the pass transistor, a second input port, and an output port coupled to the gate of the pass transistor;

a comparator circuit comprising an output port to provide the control voltage, further comprising an analog-to-digital converter comprising an input port coupled to the source of the pass transistor, and an output port;

a memory circuit to provide a first operand and a second operand;

an adder comprising an output port to provide a digital signal indicative of the sum of the first operand and the second operand;

a digital amplifier comprising an output port to provide the control voltage, a first input port coupled to the output port of the analog-to-digital converter, and a second input port coupled to the output port of the adder; and the comparator circuit further comprising a digital-to-analog converter comprising an input port coupled to the memory to receive the first operand, and an output port coupled to the second input port of the error amplifier.

28. The circuit as set forth in claim 27, wherein the digital amplifier provides loop compensation for stability.

29. A circuit comprising:

a first regulator comprising an output port to provide an output voltage in response to a control voltage;

a set of linear regulators having as an input voltage the output voltage of the first regulator, each linear regulator including a pass transistor comprising a source coupled to the output port of the first regulator, and a drain having a voltage;

a set of voltage circuits in one-to-one correspondence with the set of pass transistors, wherein each voltage circuit comprises a first port coupled to the source of its corresponding pass transistor, and comprises a second port having a voltage; and a controller circuit to provide the control voltage, and to provide a set of quantities in one-to-one correspondence with the set of voltage circuits and the set of pass transistors, where each quantity is the difference between the voltage at the second port of the corresponding voltage circuit and the drain of the corresponding pass transistor, where the control voltage is indicative of the smallest in magnitude of quantities.

30. The circuit as set forth in claim 29, the controller circuit comprising a set of comparator circuits in one-to-one correspondence with the set of voltage circuits and the set of pass transistors;

each comparator circuit comprising a first input port coupled to the second port of the corresponding voltage circuit;

a second input port coupled to the drain of corresponding pass transistor; and an output port to provide an output voltage; and an OR circuit comprising a set of diodes in one-to-one correspondence with the set of comparator circuits, each diode comprising a first port coupled to the output port of the corresponding comparator circuit and a second port, wherein the second ports for each diode are coupled to each other to provide the control voltage.

31. The circuit as set forth in claim 30, wherein the first input port of each diode is an anode and the second input port of each diode is a cathode.

32. The circuit as set forth in claim 29, wherein each voltage circuit comprises a transistor comprising a source coupled to the source of the corresponding pass transistor, and a drain;

a node;

a first voltage circuit to provide a first voltage difference between the drain of the transistor and the node; and a second voltage circuit to provide a second voltage difference between the node and the first input port of the corresponding comparator circuit.

33. The circuit as set forth in claim 32, wherein for each voltage circuit the transistor has a source-drain current and the voltage circuit comprises a current source to set the source-drain current of the transistor.

34. The circuit as set forth in claim 29, the controller circuit comprising:

a multiplexer comprising a set of first input ports in one-to-one correspondence with the set of voltage circuits, where each first input port is coupled to the second port of the corresponding voltage circuit, each first input port having a voltage, a set of second input ports in one-to-one correspondence with the set of first input ports and the set of pass transistors, where each second input port is coupled to the drain of the corresponding pass transistor, each second input port having a voltage; and two output ports to provide at time intervals the voltages of corresponding first and second input ports;

a differential analog-to-digital converter comprising two input ports coupled to the two output ports of the multiplexer, and comprising an output port having digital values the digital values at time intervals corresponding to the analog differential voltages at its input ports;

a negative peak detector comprising an input port coupled to the output port of the differential analog-to-digital converter, and comprising an output port, providing an output signal indicative of the minimum of the digital values; and an error amplifier comprising an input port coupled to the output port of the peak detector, and comprising an output port to provide the control voltage in digital form.

35. A circuit comprising:

a first regulator comprising an output port to provide an output voltage in response to a control voltage;

a set of linear regulators having as an input voltage the output voltage of the first regulator, each linear regulator including a pass transistor, each pass transistor comprising a source coupled to the output port of the regulator, a gate, and a drain;

a set of comparators in one-to-one correspondence with the set of pass transistors, wherein each comparator comprises a first input port coupled to the drain of the corresponding pass transistor, a second input port, and an output port coupled to the gate of the corresponding pass transistor; and a comparator circuit comprising memory to store a set of first operands in one-to-one correspondence with the set of comparators, and to store a set of second operands in one-to-one correspondence with the first operands;

a set of digital-to-analog converters in one-to-one correspondence with the set of first operands and the set of comparators, each digital-to-analog converter comprising an input port to receive the corresponding first operand and an output port coupled to the second input port of the corresponding comparator;

a discriminator circuit to provide an output signal indicative of the maximum of a set of quantities, the set of quantities in one-to-one correspondence with the set of first operands and the set of second operands, each quantity equal to the sum of the corresponding first operand and the corresponding second operand;

an analog-to-digital converter comprising an input port coupled to the source of the pass transistors, and an output port; and a digital error amplifier comprising a first input port coupled to the output port of the analog-to-digital converter, a second input port to receive the output signal of the discriminator circuit, and an output port to provide the control voltage in digital form.

36. The circuit as set forth in claim 35, wherein the first regulator is a digitally controlled switching regulator.

37. The circuit as set forth in claim 35, wherein the digital error amplifier provides loop compensation for stability.

38. A method comprising:

generating a voltage substantially equal to a minimum voltage drop across a MOSFET pass transistor of a linear voltage regulator, having and input voltage and an output voltage, such that the pass transistor operates in its saturated operating mode;

generating the input voltage of the linear voltage regulator at the output of a first voltage regulator;

generating a control voltage based upon the generated voltage and the output voltage of the linear regulator; and controlling the output voltage of the first voltage regulator based upon the control voltage.

39. The method as set forth in claim 38, further comprising:

controlling the first voltage regulator so that its output voltage is above the output voltage of the linear voltage regulator by an amount substantially equal to the minimum voltage drop.

40. The method as set forth in claim 39, wherein the linear voltage regulator is a low-drop-out voltage regulator.

41. The method as set forth in claim 38, wherein the first voltage regulator is a switching voltage regulator.

42. The method as set forth in claim 38, wherein generating a voltage substantially equal to a minimum voltage drop across a pass transistor includes generating a drain-to-source voltage across a transistor matched to the pass transistor except for size.

43. A method comprising:

generating a set of voltages substantially equal to a set of minimum voltage drops across a set of MOSFET pass transistors of a set of linear voltage regulators, each having a common input voltage and an output voltage, such that each pass transistor operates in its saturated operating mode;

generating the input voltage of the set of linear voltage regulators at the output of a first voltage regulator;

generating a control voltage based upon the the set of generated voltages and the corresponding linear voltage regulator output voltages; and controlling the output voltage of the first voltage regulator based upon the control voltage.

44. The method as set forth in claim 43, further comprising:

controlling the first voltage regulator so that its output voltage is substantially equal or above the maximum of a second set of voltages, wherein each voltage within the second set of voltages corresponds to the sum of the output voltage of a linear voltage regulator and its corresponding generated voltage.

45. The method as set forth in claim 44, wherein each linear voltage regulator is a low-drop-out voltage regulator.

46. The method as set forth in claim 43, wherein the first voltage regulator is a switching voltage regulator.

47. A circuit comprising:

a second voltage regulator having an input voltage and an output voltage, the input voltage of which is being supplied by an output voltage of a first voltage regulator, the second voltage regulator including:

a MOSFET pass transistor having a minimum voltage drop when operating in a saturated operating mode;

a first circuit to generate a generated voltage substantially equal to the minimum voltage drop;

a controller to generate a control voltage based upon the generated voltage;

wherein the controller controls the output voltage of the first voltage regulator based upon the control voltage.

48. The circuit as set forth in claim 47, wherein the controller controls the first voltage regulator so that its output voltage is above the output voltage of a second voltage regulator by an amount substantially equal to the minimum voltage drop.

49. The circuit as set forth in claim 48, wherein the second voltage regulator is a low-drop-out voltage regulator.

50. The circuit as set forth in claim 47, wherein the first voltage regulator is a switching voltage regulator.

51. The circuit as set forth in claim 47, wherein the first circuit comprises a transistor matched to the pass transistor except for size.

52. A circuit comprising:

a set of linear voltage regulators each having a common input voltage, an output voltage and a pass transistor, each pass transistor being a MOSFET transistor having a minimum voltage drop while operating in a saturated operating mode;

a set of first circuits in one-to-one correspondence with the set of pass transistors to generate a set of generated voltages, where each generated voltage substantially equals the minimum voltage drop of the corresponding pass transistor;

a set of nodes in one-to-one correspondence with the set of pass transistors each node having a voltage which is substantially equal to the difference of the common input voltage and the generated voltage of the corresponding pass transistor;

a first voltage regulator having an output voltage that supplies the input voltage of the set of linear regulators, and a controller to generating a control voltage based upon the minimum voltage difference between the set of node voltages and their corresponding linear regulator output voltages, where the controller controls the output voltage of the first voltage regulator based upon the control voltage.

53. The circuit as set forth in claim 52, wherein the controller controls the first voltage regulator so that its output voltage is above the output voltages of the set of linear voltage regulators by an amount greater than or substantially equal to the corresponding minimum voltage drop.

54. The circuit as set forth in claim 52, wherein the first voltage regulator is a switching voltage regulator.

* * * * *